US010328707B2

(12) United States Patent
Ichihara et al.

(10) Patent No.: US 10,328,707 B2
(45) Date of Patent: Jun. 25, 2019

(54) LIQUID CONTAINER

(71) Applicant: SEIKO EPSON CORPORATION, Tokyo (JP)

(72) Inventors: Keita Ichihara, Matsumoto (JP); Kazuyuki Hirata, Matsumoto (JP); Ryota Takahashi, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 15/906,523

(22) Filed: Feb. 27, 2018

(65) Prior Publication Data

US 2018/0244053 A1 Aug. 30, 2018

(51) Int. Cl.
*B41J 2/175* (2006.01)

(52) U.S. Cl.
CPC ..... *B41J 2/1753* (2013.01); *B41J 2/1754* (2013.01); *B41J 2/17526* (2013.01); *B41J 2/17553* (2013.01)

(58) Field of Classification Search
CPC .... B41J 2/1753; B41J 2/17526; B41J 2/1754; B41J 2/17553
See application file for complete search history.

(56) References Cited

U.S. PATENT DOCUMENTS 8,297,738 B1 10/2012 Kodama et al.
8,955,950 B2 2/2015 Nose
2002/0085075 A1 7/2002 Shinada et al.
2009/0096850 A1 * 4/2009 Sulser ..... B41J 2/17513 347/86
2012/0056954 A1 3/2012 Asauchi et al.
2014/0071210 A1 3/2014 Nose

FOREIGN PATENT DOCUMENTS

EP 2 883 703 A1 6/2015
JP 2014-054787 A 3/2014

OTHER PUBLICATIONS

Extended European Search Report dated Jul. 26, 2018 in related European Appl. 18158587.8 (10 pgs.).

* cited by examiner

*Primary Examiner* — Sharon A. Polk
(74) *Attorney, Agent, or Firm* — Foley & Lardner LLP

(57) ABSTRACT

Provided is a technique that makes it possible to mitigate impact acting on a liquid container. The liquid container includes a liquid storage portion that is surrounded by a plurality of wall portions, and contains liquid therein, and a plurality of contact portions that are provided on a first wall portion among the plurality of wall portions, and are in contact with terminals on-the-apparatus-side provided in a liquid consumption apparatus. The contact portions are provided at a position close to a first edge side, at least some of the plurality of contact portions form at least one column arranged along the first edge side, the liquid container includes protruding portions outward of outer contact portions, and the protruding portions are provided between an end portion the first edge side of the outer contact portions and the first edge side in a direction from the first edge side toward the column.

3 Claims, 22 Drawing Sheets

LIQUID CONTAINER

CROSS-REFERENCE TO RELATED APPLICATIONS

The present application claims the priority based on Japanese Patent Applications No. 2017-035662 filed on Feb. 28, 2017, the disclosure of which is hereby incorporated by reference in their entirety.

BACKGROUND

1. Technical Field

The present invention relates to a liquid container.

2. Related Art

JP-A-2014-54787 discloses a liquid container that is mounted to a liquid consumption apparatus.

JP-A-2014-54787 is an example of related art.

Liquid containers are filled with liquid. Therefore, for example, when such a liquid container is dropped, impact that is transmitted to a liquid container is larger than in a case where a liquid container without liquid is dropped. The larger the impact that is transmitted to the liquid container is, the more likely that the constituent parts that constitute the liquid container and joint portions between the constituent parts will be damaged or break. In particular, a liquid container used for a liquid consumption apparatus that performs printing on large-sized paper is filled with a large amount of liquid, and thus such a problem is significant. Therefore, there is demand for a technique that makes it possible to mitigate impact on the liquid container when the liquid container is dropped or hits another object.

SUMMARY

The invention has been made in order to solve at least a portion of the above-described issue, and can be realized as the following mode.

1. According to one mode of the invention, a liquid container that contains liquid that is used in a liquid consumption apparatus is provided. This liquid container includes a liquid storage portion that is surrounded by a plurality of wall portions, and contains liquid therein, and a plurality of contact portions are provided on a first wall portion among the plurality of wall portions, the plurality of contact portions contact with terminals on-the-apparatus-side provided in the liquid consumption apparatus, when the liquid container is mounted in the liquid consumption apparatus. The plurality of contact portions are provided at a position close to a first edge side among the first edge side and a second edge side of the first wall portion, the first edge side and a second edge side are arranged face each other, at least some contact portions, from among the plurality of contact portions, form at least one column arranged along the first edge side, the liquid container includes protruding portions outward of outer contact portions that are the outermost contact portions in the column, and the protruding portions are provided between an end portion on the first edge side of the outer contact portions and the first edge side in a direction from the first edge side toward the column. With the liquid container having such a mode, the protruding portions are provided outward of the contact portions, and thus it is possible to mitigate impact on the contact portions constituting the liquid container.

2. In the liquid container in the above mode, the protruding portions may protrude more than the plurality of contact portions. In such a mode, it is possible to more effectively mitigate impact on the contact portions.

3. In the liquid container in the above mode, a second wall portion that intersects the first wall portion may be included, a liquid supply portion for supplying the liquid to the liquid consumption apparatus may be provided on the second wall portion, and the liquid supply portion may be provided on the second wall portion, at a position close to the first edge side of the first wall portion. In such a mode, the liquid supply portion, the contact portions, and the protruding portions are arranged so as to be gathered at a portion of the liquid container. Therefore, even if the size of the liquid storage portion is changed, the mounting compatibility of the liquid container to the liquid consumption apparatus can be easily maintained.

The invention can be realized in various modes in addition to the modes as the above-described liquid container. For example, the invention can be realized in modes such as a liquid consumption apparatus that has a liquid container, and a liquid consumption system that has a liquid container and a liquid consumption apparatus.

DESCRIPTION OF EXEMPLARY EMBODIMENTS

A. Configuration of Liquid Consumption System

Figure 1:
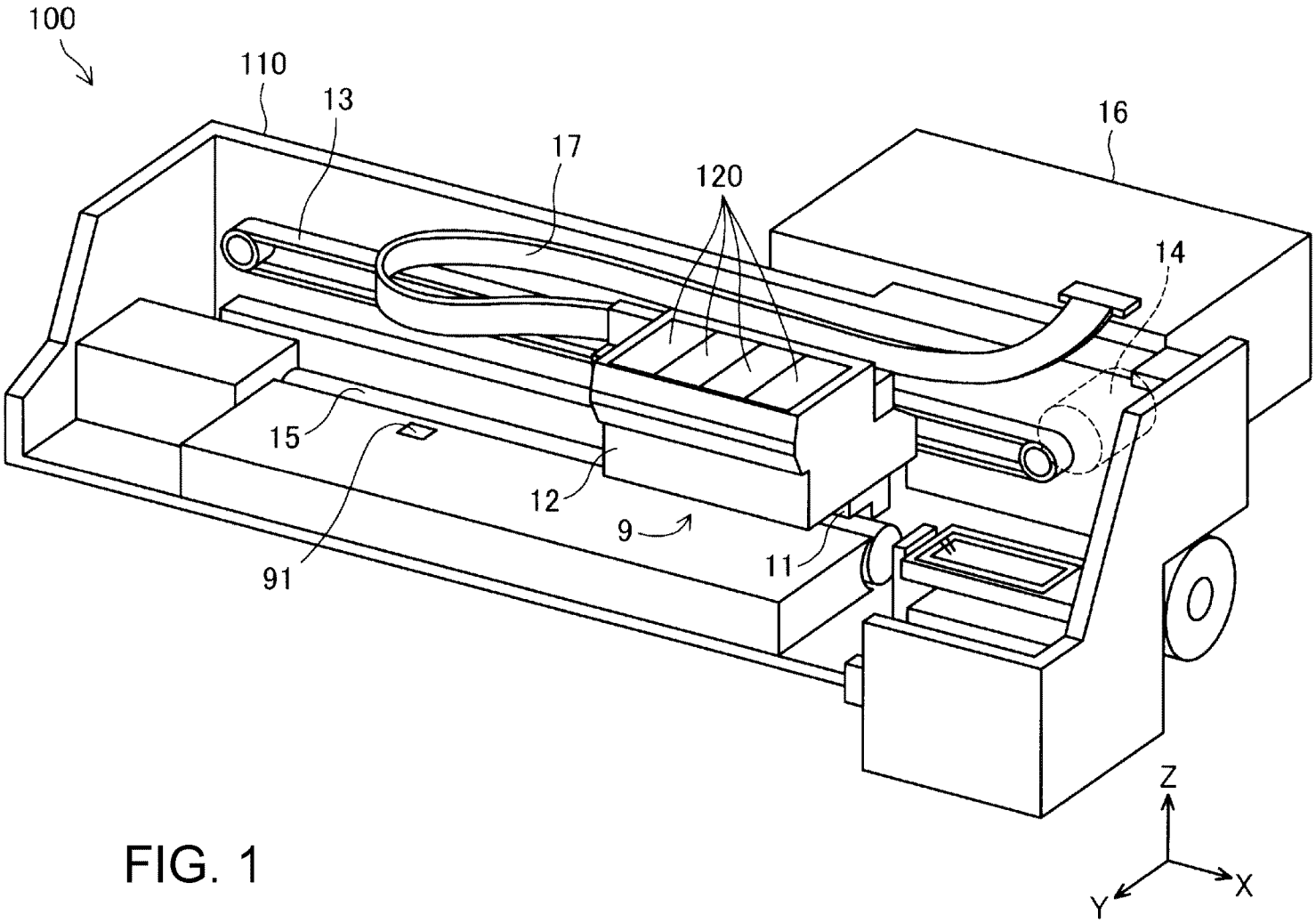
FIG. 1 is a perspective view showing a schematic configuration of a liquid consumption system.

FIG. 1 is a perspective view showing a schematic configuration of a liquid consumption system 100 in one embodiment of the invention. The liquid consumption system 100 in this embodiment has an inkjet printer 110 that is an example of a liquid consumption apparatus and cartridges 120 that are examples of a liquid container, as shown in FIG.

1. The printer 110 is a printer that can perform printing on large-sized paper exceeding an A4 size.

The cartridges 120 can contain ink that is an example of a liquid. The liquid consumption system 100 has a plurality of cartridges 120. Note that in this embodiment, the printer 110 is equipped with four cartridges 120. The liquid consumption system 100 can perform printing on a recording medium such as recording paper using ink that is an example of a liquid. Note that the number of cartridges 120 that can be mounted in the printer 110 is not limited to four, and one or more or any number of cartridges 120 can be adopted.

In FIG. 1, X, Y, and Z axes that are coordinate axes orthogonal to each other are given. In the figures shown hereinafter, the X, Y, and Z axes are given as necessary. The X, Y, and Z axes in the drawings correspond to the X, Y, and Z axes FIG. 1. FIG. 1 illustrates a state where the liquid consumption system 100 is arranged on an XY plane defined by the X axis and the Y axis. In this embodiment, a state where the liquid consumption system 100 is arranged on the XY plane when the XY plane is made to match a horizontal flat surface is an in-use state of the liquid consumption system 100. The orientation of the liquid consumption system 100 when the liquid consumption system 100 is arranged on the XY plane that is made to match a horizontal surface is called a usage orientation of the liquid consumption system 100.

The Z axis is an axis orthogonal to the XY plane. In the in-use state of the liquid consumption system 100, a +Z axis direction is the vertical upward direction. Also, in the in-use state of the liquid consumption system 100, a −Z axis direction is the vertical downward direction in FIG. 1. The −Z axis direction is also a direction in which the cartridges 120 are mounted in the printer 110. Note that regarding the X, Y, and Z axes, the direction of an arrow indicates a + (positive) direction, and a direction opposite to the direction of the arrow indicates a − (negative) direction. Note that the above-described four cartridges 120 are aligned in an X axis direction. Therefore, the X axis direction can also be defined as a direction in which the four cartridges 120 are arranged.

The printer 110 has a carriage 9, a recording head 11, and a holder 12. The carriage 9 is configured to be movable reciprocally along the X axis direction. The recording head 11 and the holder 12 are mounted in the carriage 9. The recording head 11 that is an example of a liquid jetting head is positioned in the −Z axis direction of the carriage 9. The holder 12 is positioned in the +Z axis direction of the carriage 9. The holder 12 is configured such that a plurality of cartridges 120 can be mounted thereto. The cartridges 120 are detachably mounted in the holder 12. The carriage 9 is connected to a timing belt 13. Motive power from a motor 14 is transmitted to the carriage 9 via the timing belt 13. Accordingly, the carriage 9 can move reciprocally along the X axis.

In addition, in the printer 110, motive power from a conveyance motor (not illustrated) is transmitted to a conveyance roller 15. The conveyance roller 15 extends along the X axis. In the printer 110, the motive power from the conveyance motor causes the conveyance roller 15 to rotate, and thus a recording medium can be conveyed in a Y axis direction.

Ink in the cartridges 120 mounted in the holder 12 is supplied to the recording head 11. Nozzles that are open toward the recording medium side are formed in the recording head 11. Ink supplied from the cartridges 120 to the recording head 11 is discharged as ink droplets from the nozzle openings of the recording head 11 to the recording medium.

The printer 110 further has a control unit 16 for controlling the above-described mechanisms. The recording head 11 is connected to the control unit 16 via the flexible cable 17. In the liquid consumption system 100 having the above configuration, recording is performed on a recording medium by discharging ink droplets from the recording head 11 at a predetermined position while conveying the recording medium in the Y axis direction and reciprocally moving the carriage 9 along the X axis.

The printer 110 has a detection unit 91. The detection unit 91 is connected to the control unit 16. The control unit 16 can detect the remaining state of ink in a cartridge 120 using the detection unit 91. In this embodiment, a configuration is adopted in which the remaining state of ink in a cartridge 120 is optically detected. With this configuration, the detection unit 91 has an optical element. In this embodiment, as an example of the optical element, an optical sensor that has a light emitting element and a light receiving element is adopted. A method for detecting the remaining state of ink using the detection unit 91 will be described later.

Here, a direction along the X axis is not limited to a direction that is perfectly parallel to the X axis, and also includes a direction that is inclined relative to the X axis due to an error, a tolerance, or the like, excluding a direction perpendicular to the X axis. Similarly, a direction along the Y axis is not limited to a direction that is perfectly parallel to the Y axis, and also includes a direction that is inclined relative to the Y axis due to an error, a tolerance, or the like, excluding a direction perpendicular to the Y axis. A direction along the Z axis is not limited to a direction that is perfectly parallel to the Z axis, and also includes a direction that is inclined relative to the Z axis due to an error, a tolerance, or the like, excluding a direction perpendicular to the Z axis. That is to say, a direction along an axis or a plane is not limited to a direction that is perfectly parallel to this axis or plane, and also includes a direction that is inclined relative to this axis or plane due to an error, a tolerance, or the like, excluding a direction perpendicular to this axis or plane.

Figure 2:
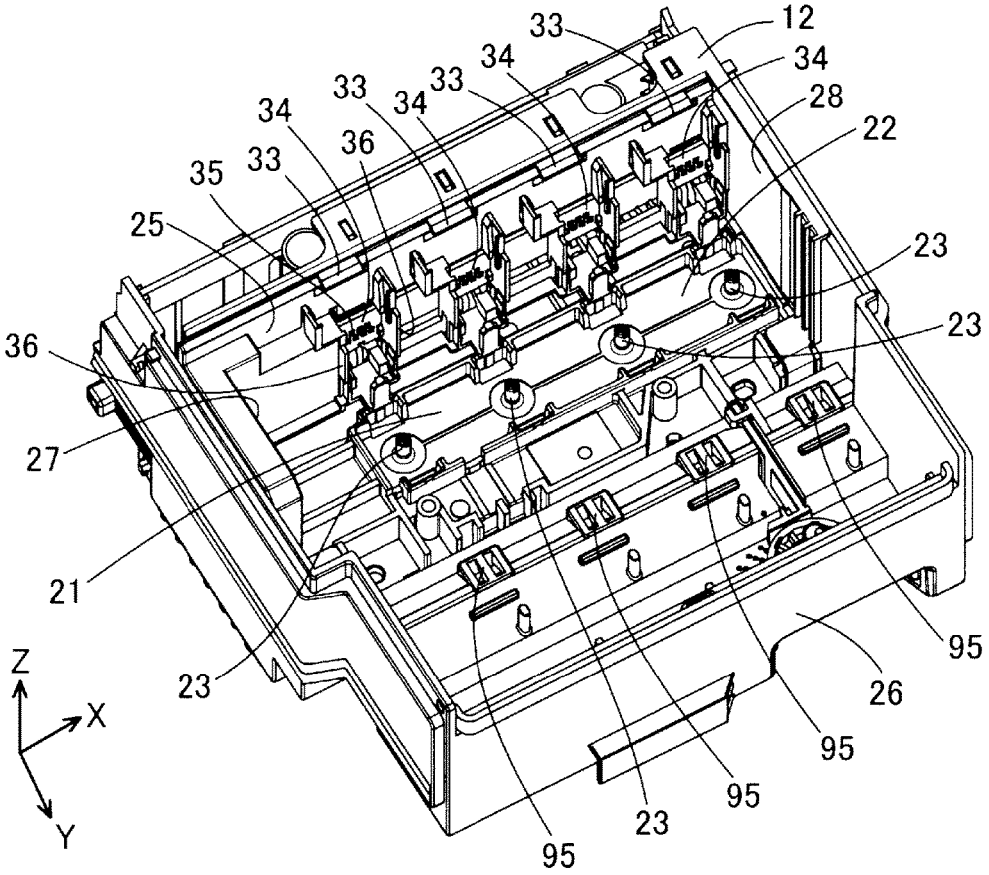
FIG. 2 is a perspective view of a holder.
Figure 3:
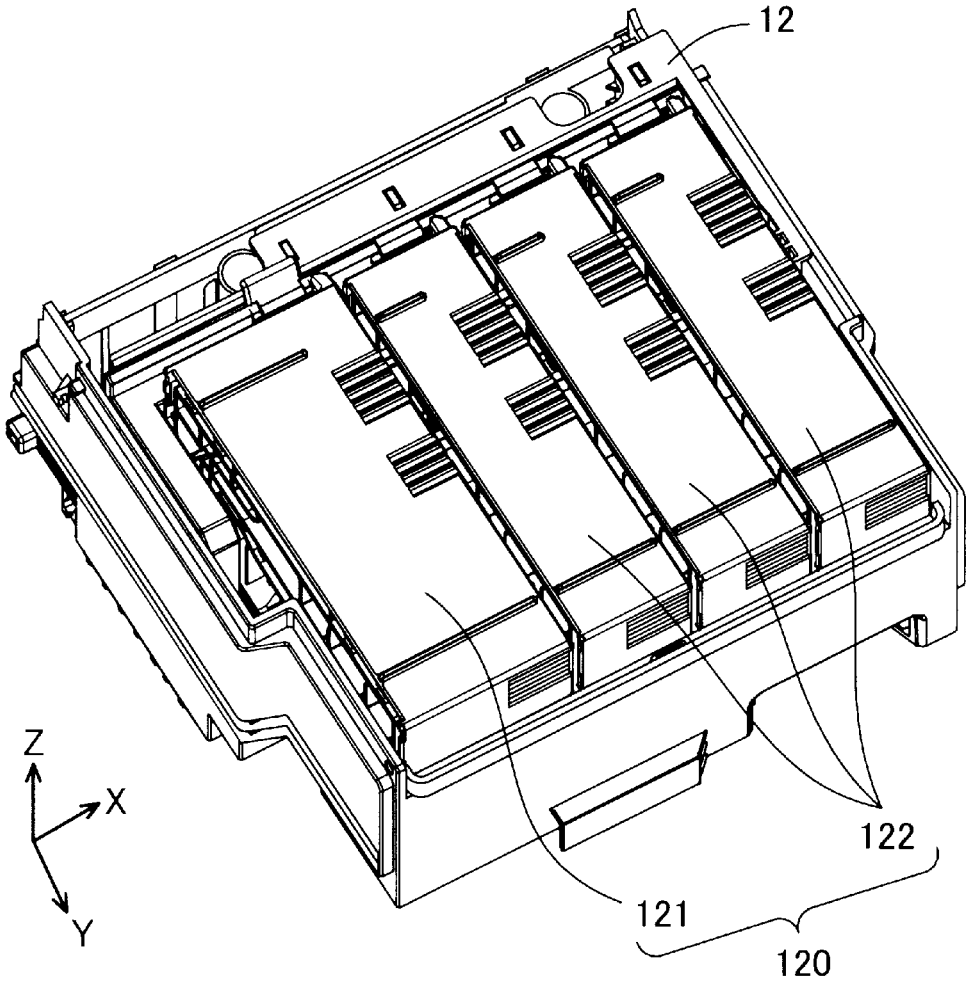
FIG. 3 is a perspective view showing a state where cartridges are mounted in the holder.

FIG. 2 is a perspective view of the holder 12. FIG. 3 is a perspective view showing a state where the cartridges 120 are mounted in the holder 12. As shown in FIG. 2, the holder 12 has a recessed portion 21. The cartridges 120 are mounted in the recessed portion 21 of the holder 12. In this embodiment, four cartridges 120 can be accommodated in the recessed portion 21. Mounting positions corresponding to the four cartridges 120 that are mounted in the recessed portion 21 are defined in the recessed portion 21. The four mounting positions are aligned along the X axis, in the recessed portion 21. Accordingly, the four cartridges 120 are accommodated in the recessed portion 21 in a state of being aligned along the X axis. As shown in FIG. 3, in this embodiment, a cartridge 121 that is mounted furthest on a −X axis direction side of the holder 12 has a width along the X axis direction larger than other cartridges 122. Black ink is contained in the cartridge 121, for example, and cyan, magenta, and yellow ink is respectively contained in the cartridges 122, for example.

Four ink introduction needles 23 are provided in a bottom portion 22 in the recessed portion 21. The ink introduction needles 23 are examples of a liquid introduction needle. The number of ink introduction needles 23 provided in the recessed portion 21 is the same as the number of cartridges 120 that can be mounted in the holder 12. The four ink introduction needles 23 protrude from the bottom portion 22 in the +Z axis direction. The four ink introduction needles 23 are aligned along the X axis. Ink contained in the cartridges 120 is supplied from the ink introduction needles 23 to the printer 110. In other words, ink contained in the cartridges 120 is supplied to the recording head 11 via the ink introduction needles 23.

The holder 12 has a first side wall 25, a second side wall 26, a third side wall 27, and a fourth side wall 28. The first side wall 25, the second side wall 26, the third side wall 27, and the fourth side wall 28 intersect the bottom portion 22, and protrude from the bottom portion 22 in the +Z axis direction.

The first side wall 25 and the second side wall 26 oppose each other along the Y axis so as to sandwich the ink introduction needle 23. The first side wall 25 is positioned in a −Y axis direction relative to the ink introduction needles 23. Also, the second side wall 26 is positioned in a +Y axis direction relative to the ink introduction needles 23. The third side wall 27 and the fourth side wall 28 oppose each other along the X axis so as to sandwich the ink introduction needles 23. The third side wall 27 is positioned in a −X axis direction relative to the ink introduction needles 23. Moreover, the fourth side wall 28 is positioned in a +X axis direction relative to the ink introduction needles 23. The bottom portion 22 is surrounded by the first side wall 25, the second side wall 26, the third side wall 27, and the fourth side wall 28. The recessed portion 21 is defined accordingly.

Note that the bottom portion 22 and the side walls 25 to 28 are not limited to flat walls, and may include recessions and protrusions, or may include a curved surface. Also, the side walls 25 to 28 do not need to be orthogonal to the bottom portion 22, and it suffices for those side walls to intersect the bottom portion 22. Moreover, two surfaces intersecting each other indicate a positional relationship in which the two surfaces are not parallel to each other. In addition to a case where two surfaces are in direct contact with each other, a relationship in which an extension of one surface and an extension of the other surface intersect each other is also expressed as "intersecting" even in a case of a positional relationship in which the two surfaces are not in direct contact and are separated from each other. The angle formed by two intersecting surfaces may be any of a right angle, an obtuse angle, and an acute angle.

The holder 12 has engaging portions 33 and contact mechanisms 34. The engaging portions 33 and the contact mechanisms 34 are provided in correspondence with the cartridges 120 that can be mounted in the holder 12. Specifically, in this embodiment, the holder 12 has four engaging portions 33 and four contact mechanisms 34. The four engaging portions 33 are aligned along the X axis direction. The four contact mechanisms 34 are aligned along the X axis.

The engaging portions 33 are provided on the first side wall 25. The engaging portions 33 are provided in the edge portion in the +Z axis direction of the first side wall 25. The engaging portions 33 protrude from the first side wall 25 in the +Y axis direction. The engaging portions 33 are each configured to be engageable with an engagement portion 54 of a cartridge 120 (see FIG. 6). Mounting of the cartridge 120 to the holder 12 is achieved by engaging the engagement portion 54 of the cartridge 120 with the engaging portion 33 of the holder 12.

The contact mechanisms 34 are provided on the first side wall 25. On the first side wall 25, the contact mechanisms 34 are positioned above the bottom portion 22. The contact mechanisms 34 each have a plurality of on-the-apparatus-side pad-shaped terminals 35. The plurality of terminals 35 on the apparatus-side have on-the-apparatus-side contact portions that are electrically connected to contact portions 58 of the cartridge 120 (see FIG. 12). The contact portions 58 of the cartridge 120 are electrically connected to the control unit 16 of the printer 110 via the contact mechanism 34. Note that in this embodiment, the terminals 35 on the apparatus-side are pad-shaped terminals, but may have any shape. For example, the terminals 35 on the apparatus-side may be pin-shaped terminals that extend from the bottom portion 22 along the first side wall 25 in the +Z axis direction, and have on-the-apparatus-side contact portions on the +Y axis direction side of the end portion on the +Z axis direction.

On the +X axis direction side and the −X axis direction side of the contact mechanism 34, on-the-apparatus-side projections 36 protruding from the first side wall 25 on the +Y axis direction side are provided at positions sandwiching the contact mechanism 34. The projections 36 on the apparatus-side are fitted in recesses 37 provided outward of protruding portions 70 (see FIG. 12) provided in the cartridge 120, and restrict movement in the X axis direction of the vicinity of the contact portions 58 of the cartridge 120. This suppresses contact failure between the contact mechanism 34 and the contact portions 58 on the cartridge 120 side.

B. Configuration of Appearance of Cartridge

Figure 4:
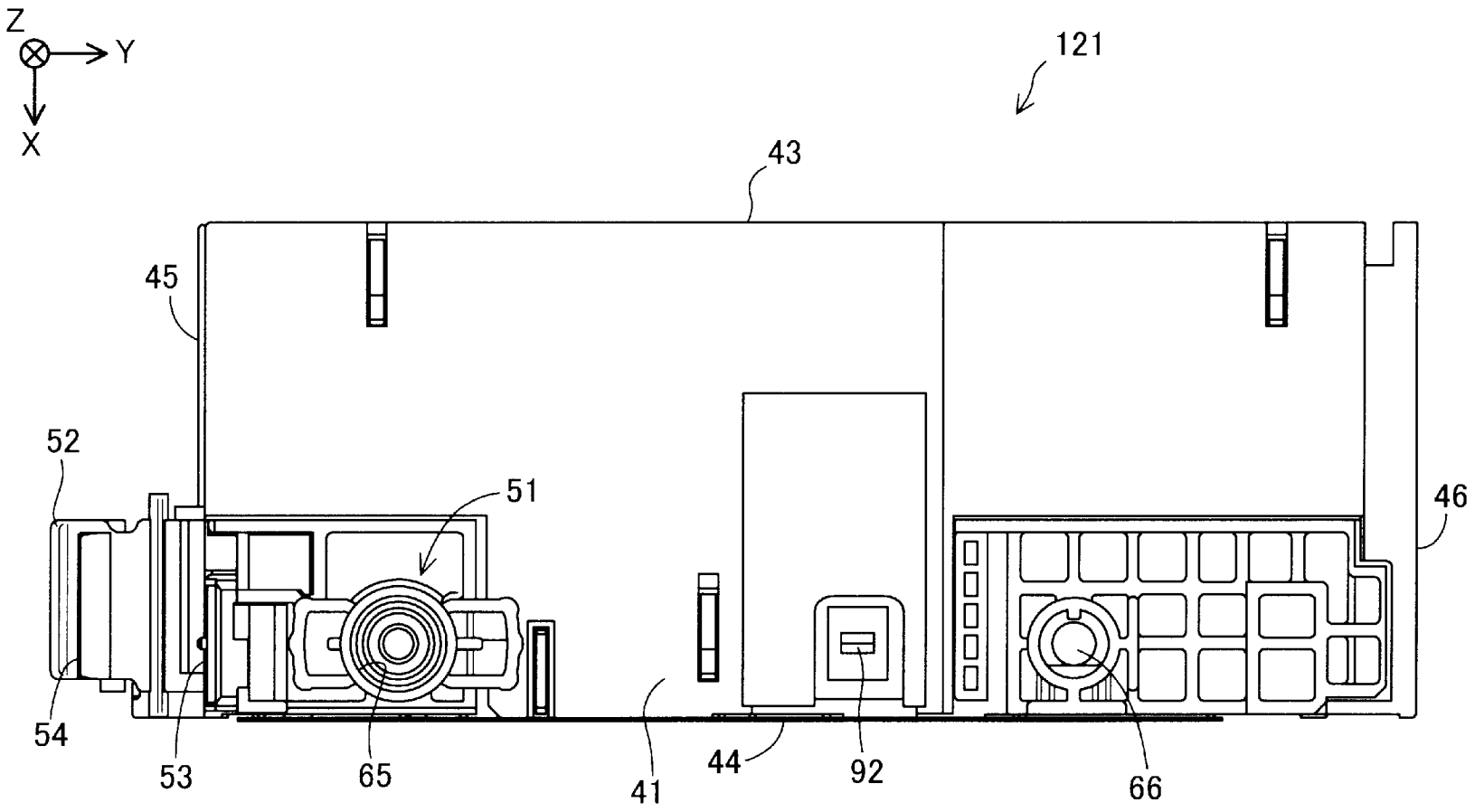
FIG. 4 is a bottom view of a cartridge.

FIG. 4 is a bottom view of the cartridge 121. As shown in FIG. 4, the cartridge 121 has a bottom wall portion 41. FIG. 4 illustrates a state where the cartridge 121 is seen in planar view in the +Z axis direction.

Figure 5:
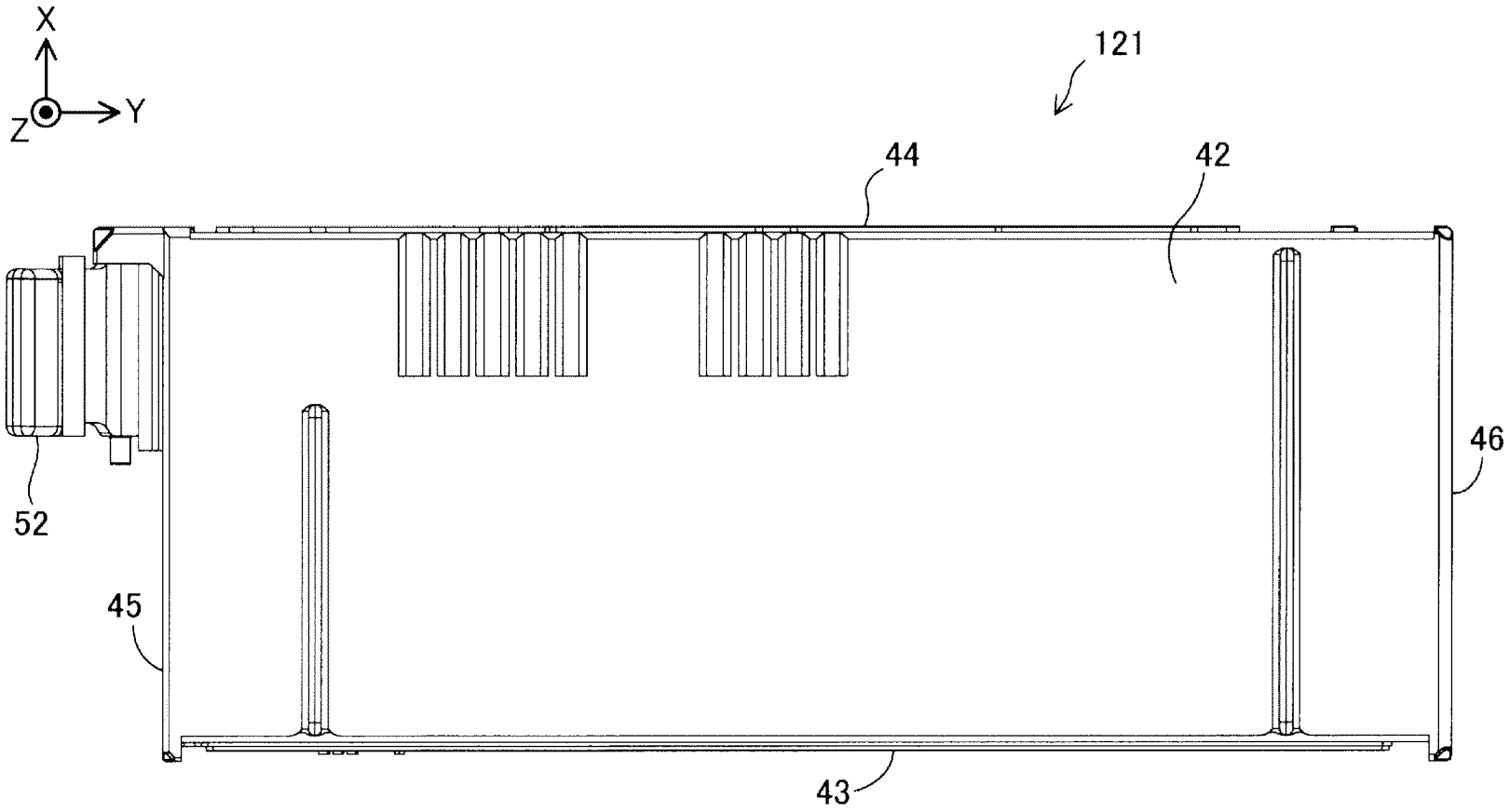
FIG. 5 is a plan view of the cartridge.

FIG. 5 is a plan view of the cartridge 121. As shown in FIG. 5, the cartridge 121 has an upper wall portion 42. FIG. 5 illustrates a state where the cartridge 121 is seen in planar view in the −Z axis direction.

Figure 6:
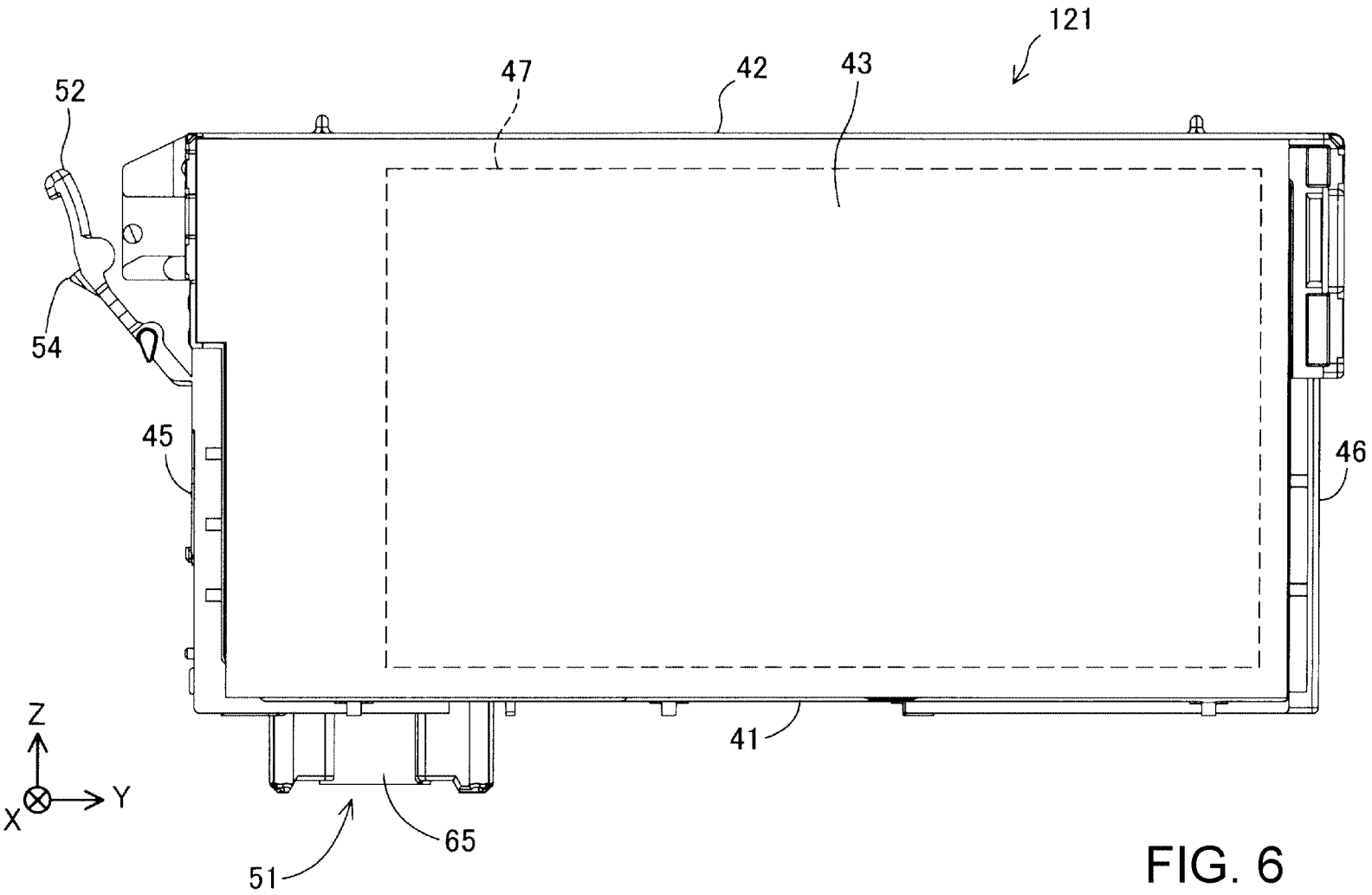
FIG. 6 is a left side view of the cartridge.

FIG. 6 is a left side view of the cartridge 121. The cartridge 121 has a left wall portion 43 as shown in FIG. 6. FIG. 6 illustrates a state where the cartridge 121 is seen in planar view in the +X axis direction.

Figure 7:
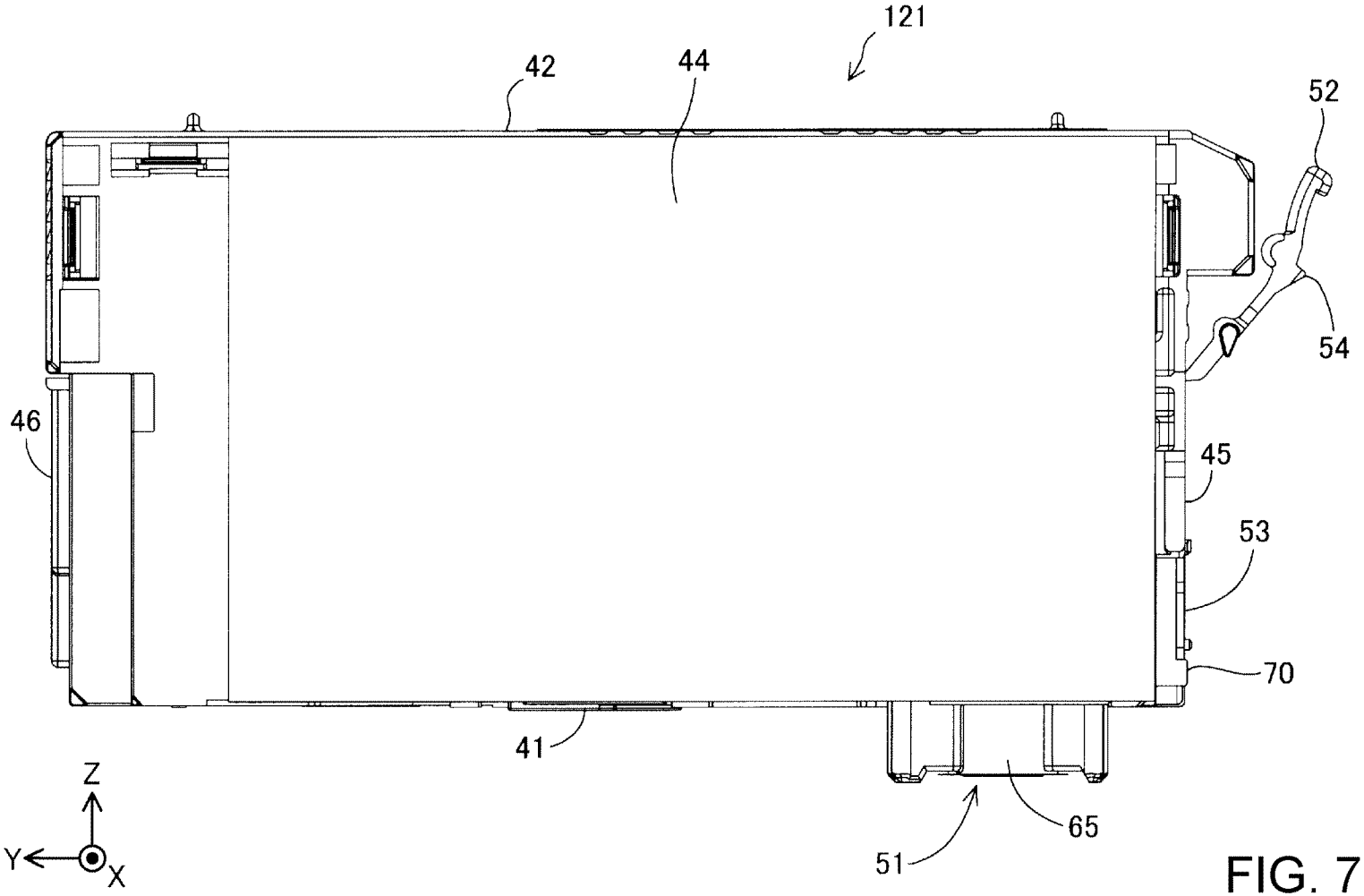
FIG. 7 is a right side view of the cartridge.

FIG. 7 is a right side view of the cartridge 121. The cartridge 121 has a right wall portion 44 as shown in FIG. 7. FIG. 7 illustrates a state where the cartridge 121 is seen in planar view in the −X axis direction.

Figure 8:
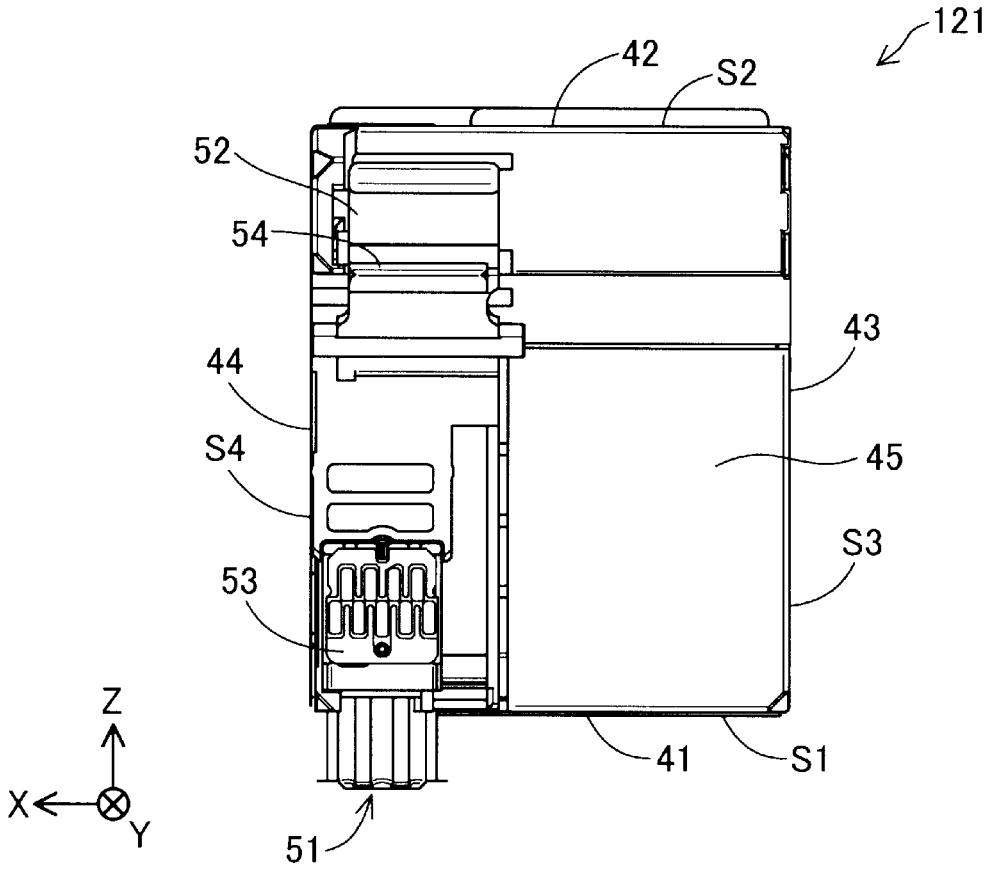
FIG. 8 is a rear view of the cartridge.

FIG. 8 is a rear view of the cartridge 121. The cartridge 121 has a rear wall portion 45 as shown in FIG. 8. FIG. 8 illustrates a state where the cartridge 121 is seen in the +Y axis direction in planar view. The rear wall portion 45 is also referred to as a "first wall portion", and the bottom wall portion 41 (FIG. 4) is also referred to as a "second wall portion".

Figure 9:
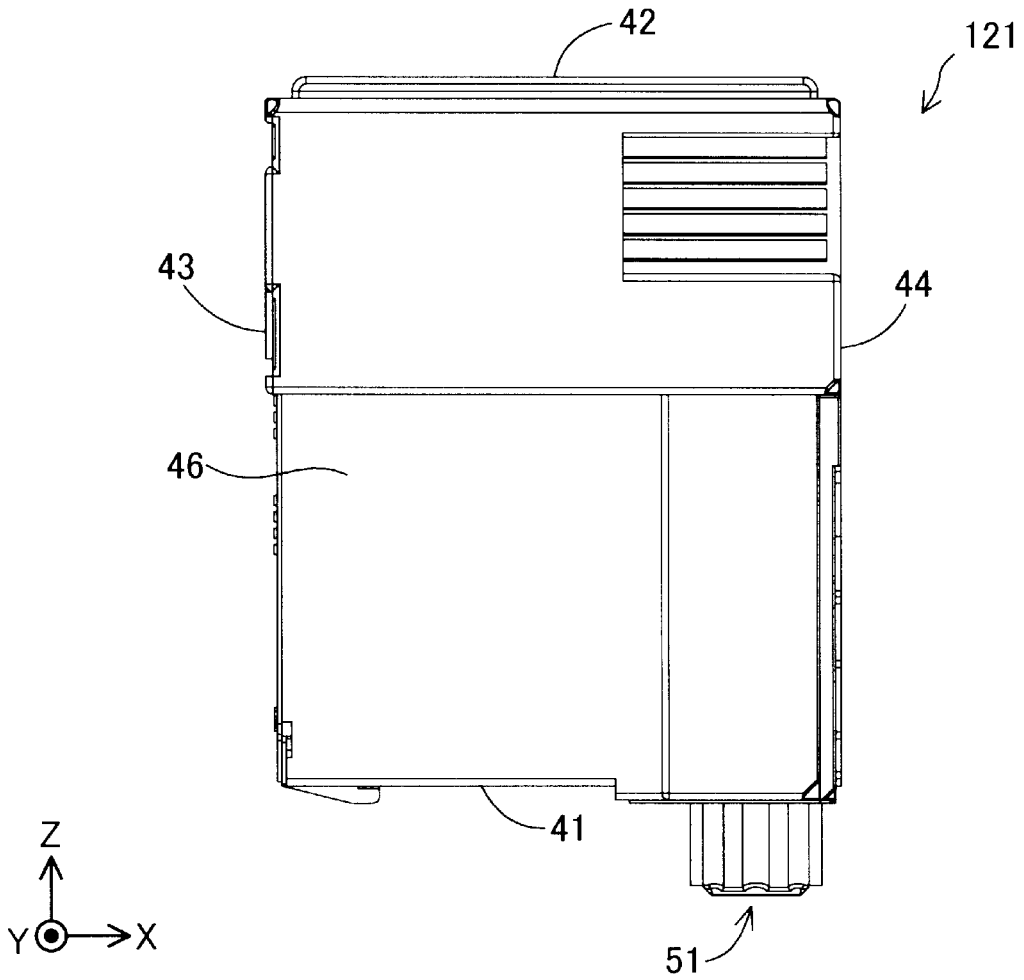
FIG. 9 is a front view of the cartridge.

FIG. 9 is a front view of the cartridge 121. The cartridge 121 has a front wall portion 46 as shown in FIG. 9. FIG. 9 illustrates a state where the cartridge 121 is seen in the −Y axis direction in planar view.

The bottom wall portion 41, the upper wall portion 42, the left wall portion 43, the right wall portion 44, the rear wall portion 45, and the front wall portion 46 of the cartridge 121 that have been described above are not limited to flat walls, and may include recessions and protrusions, or may include a curved surface. Also, the number of wall portions of the cartridge 121 is not limited to six, and may be constituted by more wall portions. In addition, the words "bottom", "upper", "left", "right", "rear", and "front" are words for distinguishing the wall portions, and the directions of the wall portions do not have to correspond to the directions indicated by these words.

The bottom wall portion 41 and the upper wall portion 42 intersect the Z axis. The bottom wall portion 41 and the upper wall portion 42 oppose each other. The upper wall portion 42 is positioned in the +Z axis direction relative to the bottom wall portion 41. The left wall portion 43 and the right wall portion 44 intersect the X axis. The left wall portion 43 and the right wall portion 44 oppose each other. The right wall portion 44 is positioned in the +X axis direction relative to the left wall portion 43. The rear wall portion 45 and the front wall portion 46 intersect the Y axis. The rear wall portion 45 and the front wall portion 46 oppose each other. The front wall portion 46 is positioned in the +Y axis direction relative to the rear wall portion 45. The bottom wall portion 41 and the upper wall portion 42 each intersect the left wall portion 43, the right wall portion 44, the rear wall portion 45 and the front wall portion 46. The left wall portion 43 and the right wall portion 44 each intersect the rear wall portion 45 and the front wall portion 46.

A liquid storage portion 47 (see FIG. 6) is formed inside a region surrounded by the six wall portions 41 to 46 of the cartridge 121. In the cartridge 121, ink is contained in the liquid storage portion 47. In other words, in the cartridge 121, ink is contained inside the region surrounded by the wall portions 41 to 46.

A lever 52 and a circuit substrate 53 are provided in the rear wall portion 45 (FIG. 8). The lever 52 protrudes from the rear wall portion 45 in the −Y axis direction, and extends in the +Z axis direction.

The above-described engagement portion 54 is provided on the lever 52 (see FIG. 7). The engagement portion 54 is formed in a portion of the lever 52 facing the opposite side to the rear wall portion 45 side, and protrudes toward the opposite side to the rear wall portion 45 side. Mounting of the cartridge 121 to the holder 12 is achieved by engaging the end portion in the +Z axis direction of the engagement portion 54 with the end portion in the −Z axis direction of the engaging portion 33 (FIG. 2) of the holder 12. Accordingly, as a result of the end portion in the +Z axis direction of the engagement portion 54 being engaged with the end portion in the −Z axis direction of the engaging portion 33, displacement of the cartridge 121 relative to the carriage 9 can be restricted. In addition, the cartridge 121 can be removed from the holder 12 by releasing engagement between the engagement portion 54 of the lever 52 and the engaging portion 33 of the holder 12 in a state where mounting of the cartridge 121 to the carriage 9 is complete. Mounting/dismounting of the cartridge 121 to/from the carriage 9 is achieved in this manner.

An atmospheric air opening port 66, a liquid supply portion 51 and a unit for detection 92 are provided on the bottom wall portion 41 (FIG. 4). The atmospheric air opening port 66 is an opening for introducing atmospheric air into the liquid storage portion 47. The atmospheric air opening port 66 will be described later in detail.

On the bottom wall portion 41, the liquid supply portion 51 is provided at a position close to an edge side S1 (FIG. 8) of the rear wall portion 45. Ink in the liquid storage portion 47 in the cartridge 121 is supplied to the ink introduction needle 23 (FIG. 2) of the holder 12 via the liquid supply portion 51. The liquid supply portion 51 is a known liquid supply mechanism configured by housing, in a cylindrical supply port 65 formed in the bottom wall portion 41, an annular sealing member into which the ink introduction needle 23 is inserted, a valve body that can come into contact with the sealing member and is pressed up by the ink introduction needle 23, and a spring member that biases the valve body toward the sealing member.

The unit for detection 92 has an optical part. In this embodiment, a prism 93 (see FIG. 10) is adopted as an example of the optical part. The unit for detection 92 penetrates the bottom wall portion 41, and is embedded in the liquid storage portion 47. In addition, in this embodiment, window portions 95 (FIG. 2) are formed in the holder 12. The window portions 95 are each formed at a position overlapping the unit for detection 92 of the cartridge 121 along the Z axis in a state where the cartridge 121 is mounted in the holder 12. The detection unit 91 shown in FIG. 1 is provided at a position overlapping a locus of the unit for detection 92 when the carriage 9 is moved along the X axis. An Ink detection process is then carried out at a position at which the unit for detection 92 and the detection unit 91 overlap each other along the Z axis.

Figure 10:
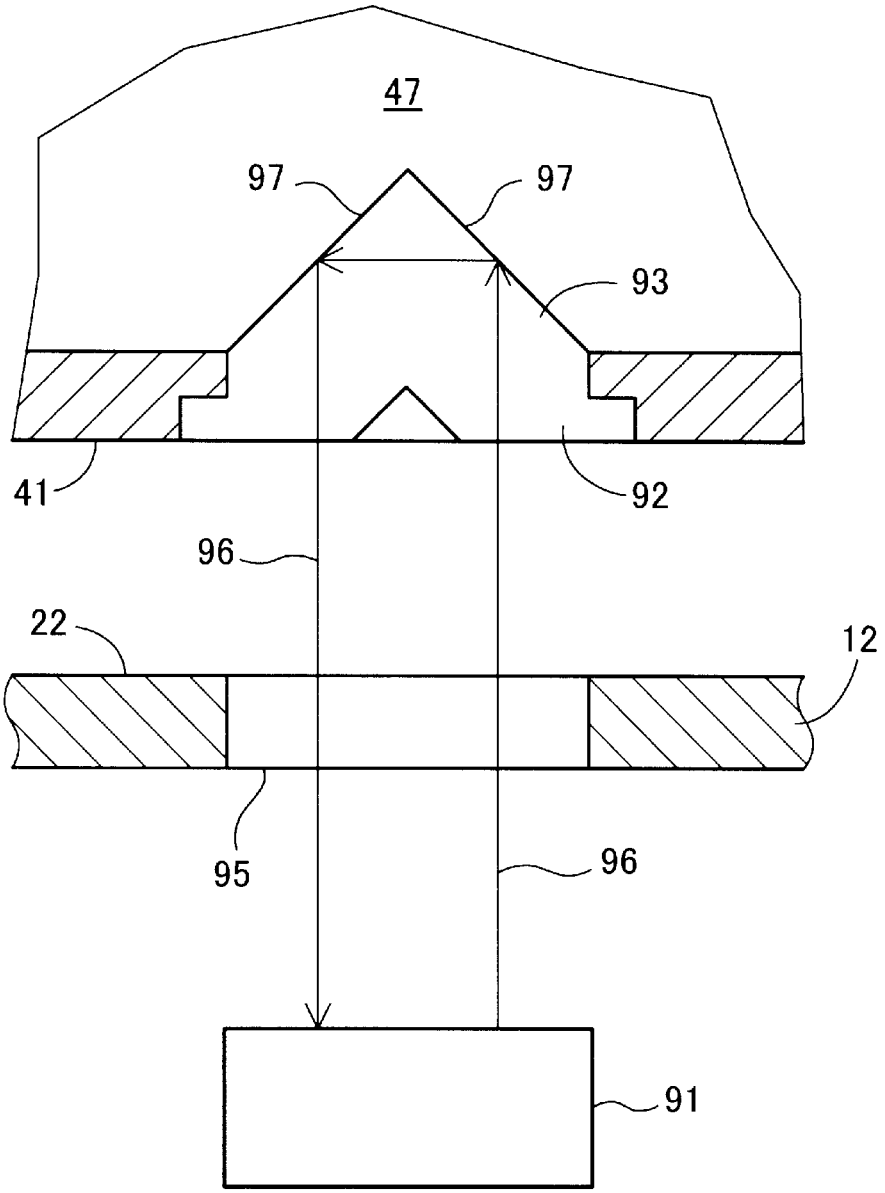
FIG. 10 is an explanatory view showing the concept of an ink detection process.

FIG. 10 is an explanatory view showing the concept of an ink detection process. When detection processing is carried out, a light beam 96 from the light emitting element of the detection unit 91 is incident to the unit for detection 92 via the window portion 95 as shown in FIG. 10. At this time, if the liquid level of ink in the liquid storage portion 47 is higher than reflective faces 97, the light beam 96 that is incident in the prism 93 exits the prism 93 from the reflective faces 97. Therefore, if the liquid level of ink in the liquid storage portion 47 is higher than the reflective faces 97, the light receiving element of the detection unit 91 cannot detect light. In this case, the control unit 16 of the printer 110 determines that there is ink. On the other hand, if the liquid level of ink in the liquid storage portion 47 is lower than the reflective faces 97, the light beam 96 that is incident in the prism 93 is reflected off the reflective faces 97 and then exits the prism 93 toward the detection unit 91. Therefore, if the liquid level of ink in the liquid storage portion 47 is lower than the reflective faces 97, the light receiving element of the detection unit 91 can detect light. In this case, the control unit 16 of the printer 110 determines that there is no ink.

Figure 11:
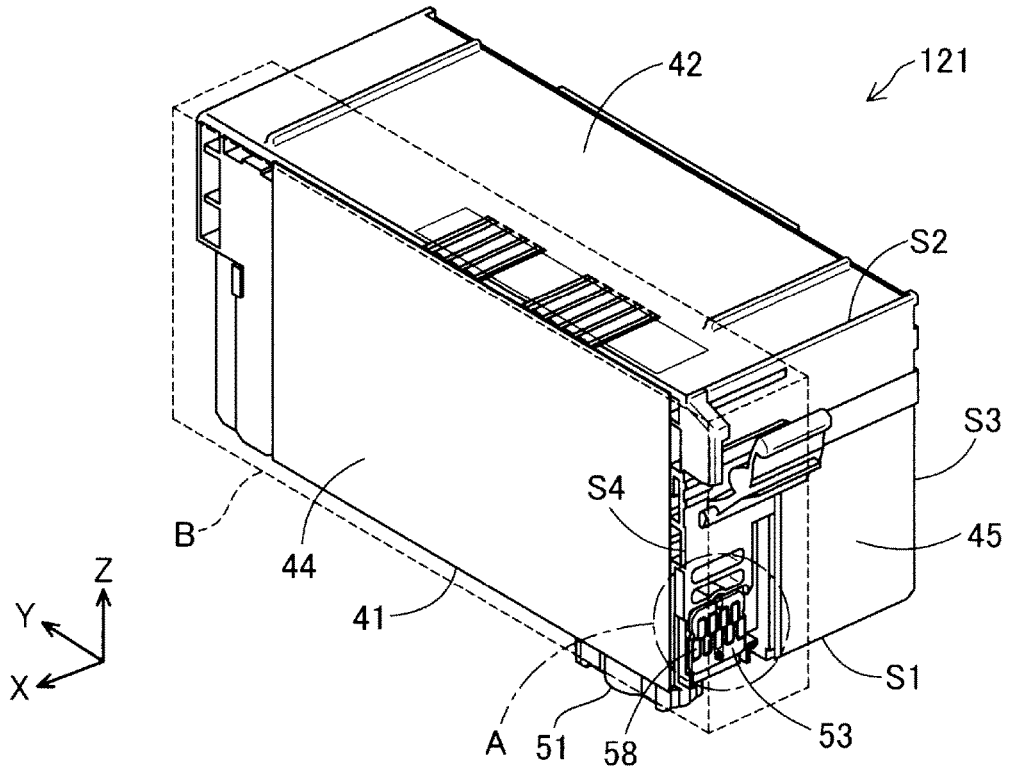
FIG. 11 is a perspective view of the cartridge.
Figure 12:
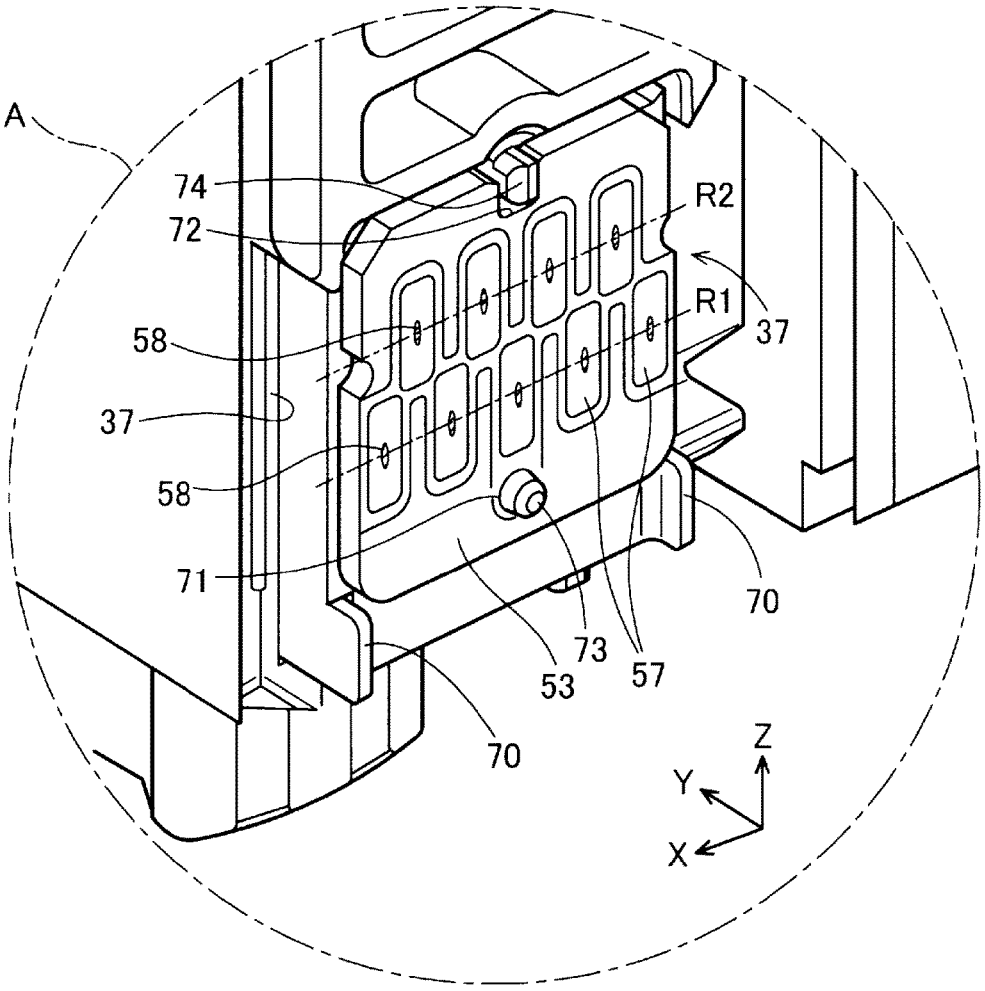
FIG. 12 is an enlarged view of a region A in FIG. 11.
Figure 13:
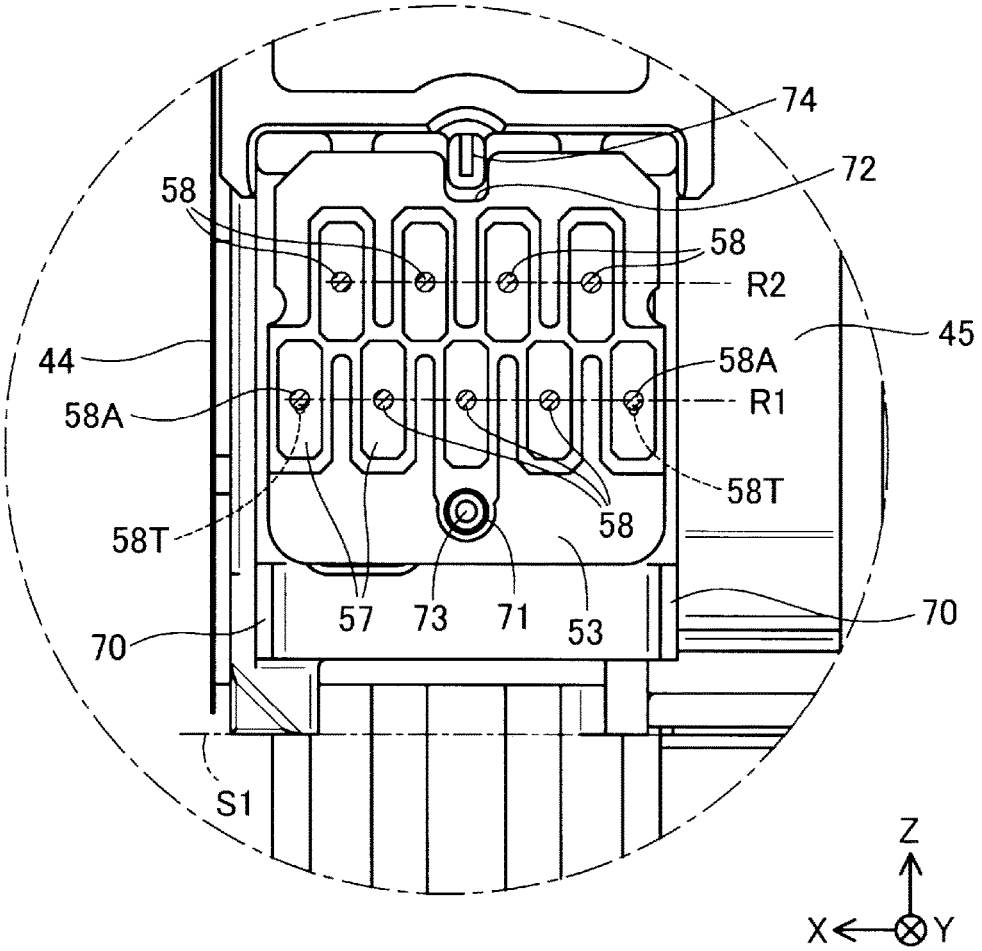
FIG. 13 is an enlarged view of a circuit substrate.

FIG. 11 is a perspective view of the cartridge 121. FIG. 12 is an enlarged view of a region A in FIG. 11. FIG. 13 is an enlarged view of the circuit substrate 53. As shown in FIG. 13, the cartridge 121 has a plurality of contact portions 58. The contact portions 58 are provided on the rear wall portion 45 (the first wall portion). In this embodiment, the circuit substrate 53 with a plurality of terminals 57 is provided on the rear wall portion 45, and the contact portions 58 are respectively configured as portions of the regions of the terminals 57. The contact portions 58 come into contact with the terminals 35 on the apparatus-side (FIG. 2) provided in the printer 110 in a state where the cartridge 121 is mounted in the printer 110. The terminals 57 or the contact portions 58 may be directly provided on the rear wall portion 45 instead of the circuit substrate 53. In this embodiment, the circuit substrate 53 is fixed to the cartridge 121 by respectively fitting columnar projections (bosses) 73 and 74 provided on the rear wall portion 45, into a boss hole 71 and a boss groove 72 provided on the circuit substrate 53, and heat caulking at least one of the projections 73 and 74. Note that the circuit substrate 53 may be fixed to the cartridge 121 using an adhesive.

At least one of the terminals 57 is electrically connected to a storage (not illustrated) provided on the back face of the circuit substrate 53. In a state where the cartridge 121 is mounted in the holder 12, the storage provided on the circuit substrate 53 of the cartridge 121 and the control unit 16 of the printer 110 (FIG. 1) are electrically connected to each other via a contact portion 58. Accordingly, various types of information is exchanged between the storage provided to the circuit substrate 53 of the cartridge 121 and the control unit 16 of the printer 110.

As shown in FIGS. 8 and 11, the rear wall portion 45 is substantially rectangular in planar view, and has a plurality of edge sides S1, S2, S3, and S4 that constitute the outer periphery of the rear wall portion 45. The edge side S1 (first edge side S1) opposes the edge side S2 (second edge side S2) in the Z axis direction, and the edge side S3 opposes the edge side S4 in the X axis direction. The circuit substrate 53 is provided at a position closer to the first edge side S1 out of the first edge side S1 and the second edge side S2. In other words, the contact portions 58 are provided at positions closer to the first edge side S1. The first edge side S1 is a side along the X axis direction, furthest on the −Z axis direction side of the rear wall portion 45. Note that in a case where recessions and protrusions directed in the −Z axis direction exist in the edge portion on the −Z axis direction of the rear wall portion 45, the first edge side S1 is a virtual straight line that is in contact with a portion protruding furthest in the −Z axis direction, and runs along the X axis direction (see FIG. 13). Similarly, in a case where recessions and protrusions directed in the +Z axis direction exist in the edge portion on the +Z axis direction of the rear wall portion 45, the second edge side S2 is a virtual straight line that is in contact with a portion protruding furthest in the +Z axis direction, and runs along the X axis direction.

As shown in FIG. 13, at least some of the contact portions 58 forms at least one row arranged along the first edge side S1. In this embodiment, the contact portions 58 form two rows R1 and R2 along the first edge side S1. The cartridge 121 has the protruding portions 70 that are outward, in the X axis direction, of outer contact portions 58A, which are the outermost contact portions 58 in the rows R1 and R2. In this embodiment, one of the protruding portions 70 is provided outward, in the −X axis direction, of the outer contact portion 58A on the −X axis direction side, and the other protruding portion 70 is provided outward, in the +X axis direction, of the outer contact portion 58A on the +X axis direction side. Accordingly, in this embodiment, the two protruding portions 70 are provided at positions sandwiching all of the contact portions 58 in the X axis direction. In this embodiment, two protruding portions 70 are provided, but one or three or more protruding portions 70 may be provided. In the case of providing only one protruding portion 70, the protruding portion 70 is preferably provided on a wall portion side closer to the contact portions 58 (in this embodiment, on the right wall portion 44 side), among the left wall portion 43 and the right wall portion 44 that intersect the rear wall portion 45. Note that in this embodiment, the contact portions 58 form the two rows R1 and R2 along the first edge side S1, but any number of rows may be formed, and only one row, namely the row R1 may be formed, for example. In addition, for example, some of the contact portions 58 of the row R1 shown in FIG. 13 may form a row. Specifically, the position of some of the contact portions 58 of the row R1 may be shifted in the +Z axis direction or the −Z axis direction, for example.

The protruding portions 70 are provided between end portions 58T on the first edge side S1 side of the outer contact portions 58A and the first edge side S1, in a direction from the first edge side S1 toward the rows R1 and R2. Accordingly, the protruding portions 70 are provided between the end portions 58T in the −Z axis direction of the outer contact portions 58A and the first edge side S1, in the Z axis direction. Also, in this embodiment, the protruding portions 70 are provided between the terminals 57 furthest on the −Z axis direction side and the first edge side S1, in the Z axis direction. In addition, in this embodiment, the protruding portions 70 are provided between the circuit substrate 53 and the first edge side S1. Note that, as long as the protruding portions 70 are provided between the end portions 58T on the −Z axis direction side of the outer contact portions 58A and the first edge side S1, the shape of the protruding portions 70 is not limited to the shape in this embodiment, and may be a shape extending to a position overlapping at least one of the terminals 57 of the circuit substrate 53 in the Z axis direction, for example, or another shape.

Furthermore, in this embodiment, as shown in FIG. 12, the protruding portions 70 protrude past the contact portions 58. More specifically, the protruding portions 70 protrude on the −Y axis direction side relative to the contact portions 58.

In this embodiment, the protruding portions 70 are substantially rectangular parallelepiped. In this embodiment, the protruding portions 70 are formed by raising a portion of the rear wall portion 45. However, the protruding portions 70 may be formed by raising, in the −Y axis direction, a portion of the edge portion in the −Y axis direction of the right wall portion 44 that is a wall intersecting the rear wall portion 45, for example. In addition, constituent elements that constitute the protruding portions 70 may be attached to the cartridge 121.

Figure 14:
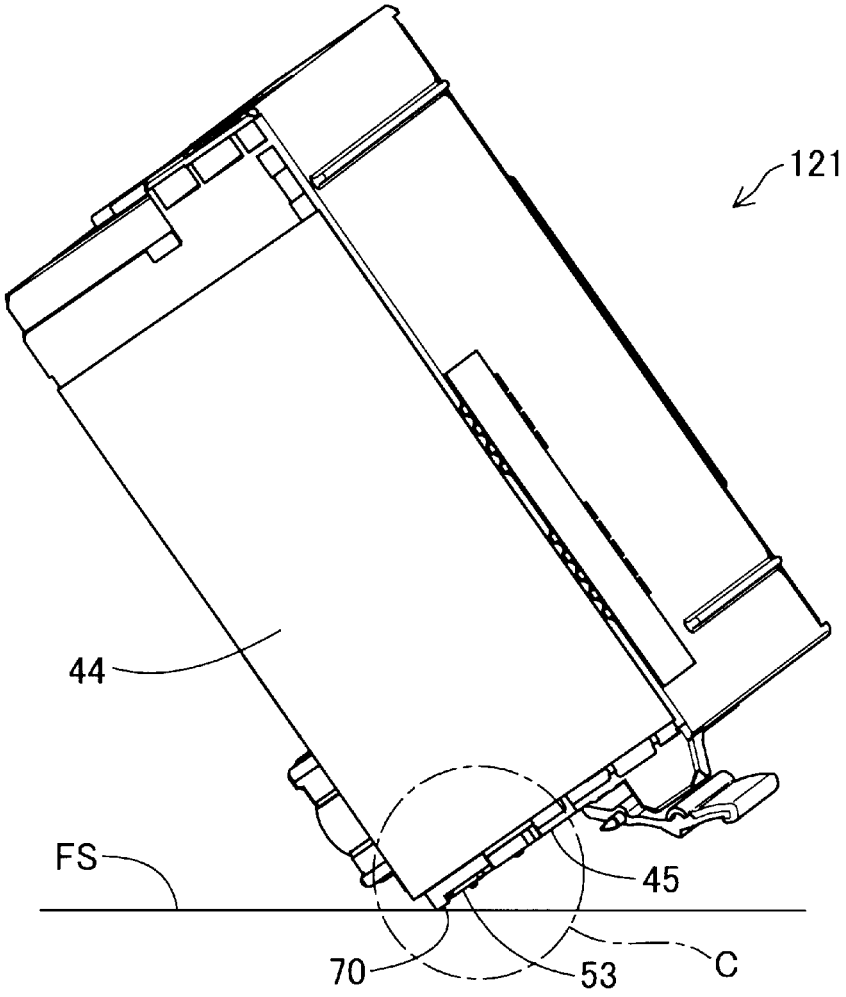
FIG. 14 is a diagram for illustrating an effect in this embodiment.
Figure 15:
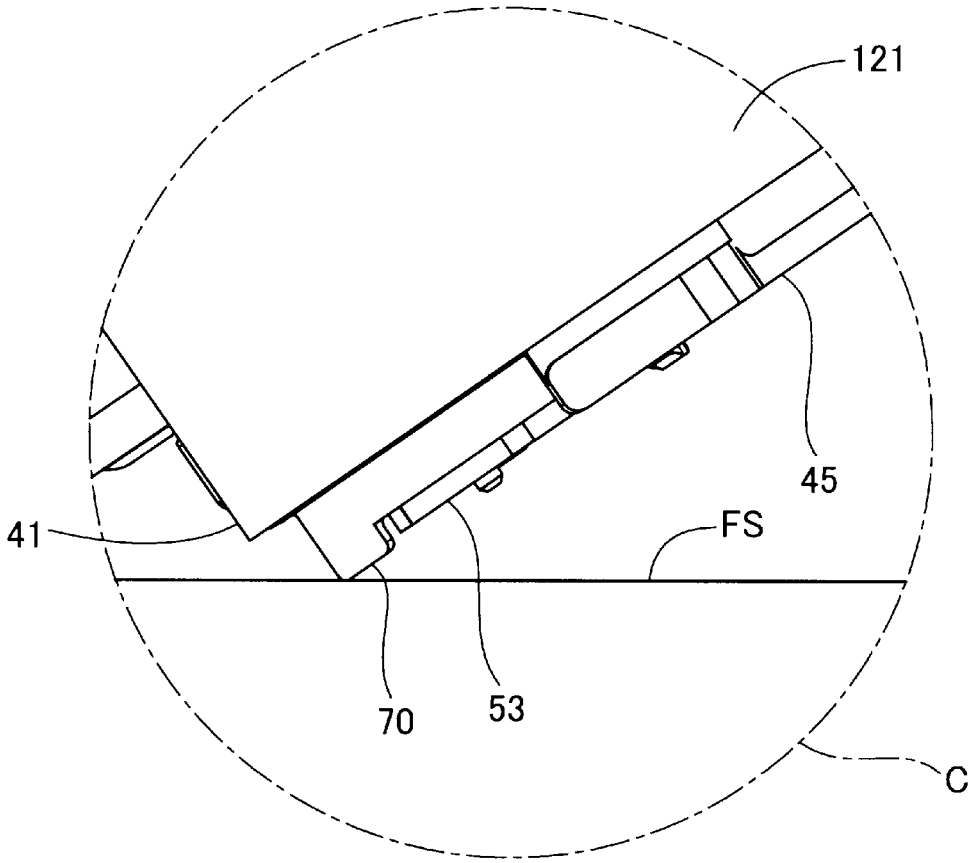
FIG. 15 is an enlarged view of a region C in FIG. 14.
Figure 16:
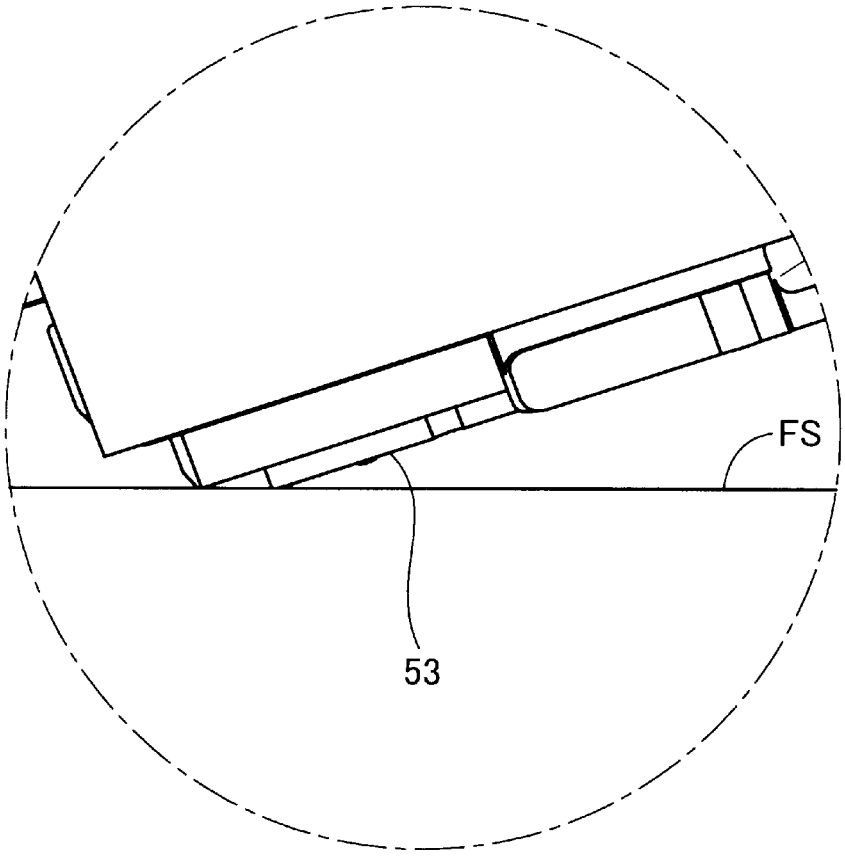
FIG. 16 is a diagram showing a comparison example.

FIG. 14 is a diagram for illustrating an effect in this embodiment. FIG. 15 is an enlarged view of a region C in FIG. 14. FIG. 16 is a diagram showing a comparison example. As shown in FIG. 14, in a case where the cartridge 121 is dropped onto a fall surface FS from a corner thereof, an impact load is input intensively from the corner, and thus if a constituent part is arranged in the vicinity of the corner, there is a possibility that the constituent part will be damaged or break. Therefore, if the protruding portions 70 are not provided at a corner as in the comparison example shown in FIG. 16, the circuit substrate 53 will come into direct contact with the fall surface FS, and there is the possibility that the circuit substrate 53 and the terminals 57 provided on the circuit substrate 53 or the contact portions 58 will be damaged or break. However, in this embodiment, the protruding portions 70 are provided in the vicinity of a corner of the cartridge 121 as shown in FIG. 15, and thus the circuit substrate 53 will not come into direct contact with the fall surface FS. Therefore, according to this embodiment, it is possible to mitigate the impact on the cartridge 121 when the cartridge 121 is dropped, hits another object, or the like, and suppress damage or breakage of the circuit substrate 53, the terminals 57, and the contact portions 58 that are constituent parts constituting the cartridge 121. In addition, according to this embodiment, it is also possible to suppress damage or breakage of the joint portion between the circuit substrate 53 and the cartridge 121. In particular, the cartridge 121 is filled with a larger amount of ink than the cartridge 122, and thus impact transmitted to the cartridge 121 is likely to be large when the cartridge 121 is dropped. Therefore, an effect of mitigating impact using the protruding portions 70 becomes particularly significant.

In addition, in this embodiment, as shown in FIGS. 12 and 13, the protruding portions 70 are provided outward of the contact portions 58 in the X axis direction, and thus it is possible to suppress contact of the protruding portions 70 with the terminal 35 on the apparatus-side provided in the holder 12 when mounting the cartridge 121 to the holder 12 from the +Z axis direction in the −Z axis direction. Therefore, the cartridge 121 can be smoothly mounted to the holder 12. In addition, it is possible to suppress contact of the protruding portions 70 with the terminal 35 on the apparatus-side when mounting the cartridge 12, and thus it is possible to suppress chipping of the protruding portions 70 due to the terminal 35 on the apparatus-side when mounting the cartridge 12. Therefore, the adherence of shavings of the protruding portions 70 to the contact portions 58 is suppressed. Therefore, it is possible to suppress the occurrence of contact failure between the terminal 35 on the apparatus-side and the contact portions 58. In addition, in this embodiment, the protruding portions 70 are provided outward of the circuit substrate 53 in the X axis direction, and thus, in a case where the cartridge 121 falls on the right wall portion 44 or the left wall portion 43, it is possible to suppress the circuit substrate 53 from directly hitting the fall surface FS. Furthermore, in this embodiment, the protruding portions 70 are not provided over the entire outer periphery of the circuit substrate 53, and thus the assemblability of the circuit substrate 53 to the cartridge 121 is not hampered by the protruding portions 70.

In addition, according to this embodiment, the protruding portions 70 protrude past the contact portions 58 in the −Y axis direction, and thus it is possible to more effectively mitigate the impact on the contact portions 58. Note that the height of the protruding portions 70 may be the same as that of the contact portions 58. Also with such a configuration, it is possible to reduce the possibility that the circuit substrate 53 or the contact portions 58 will come into direct contact with the fall surface FS and be damaged or break in a case where the cartridge 121 is dropped on a corner thereof.

In addition, in this embodiment, the liquid supply portion 51 is provided in the bottom wall portion 41, and the liquid supply portion 51 is provided at a position on the edge side S1 side of the bottom wall portion 41. Accordingly, in this embodiment, at a position in the rear wall portion 45 close to the right wall portion 44 and the bottom wall portion 41, the liquid supply portion 51, the contact portions 58 and the protruding portions 70 are provided at positions close to each other. Therefore, for example, even if the sizes in the X axis direction and the Z axis direction of the cartridge 121 are changed in order to change the ink capacity of the cartridge 121, the positions of the liquid supply portion 51, the contact portions 58, and the protruding portions 70 do not need to be changed. Therefore, the mounting compatibility of the cartridge 121 to the printer 110 can be easily maintained. As a result, for example, the structure in a region B enclosed using a broken line in FIG. 11 can be shared by the cartridge 121 and the cartridge 122.

C. Internal Configuration of Cartridge

Figure 17:
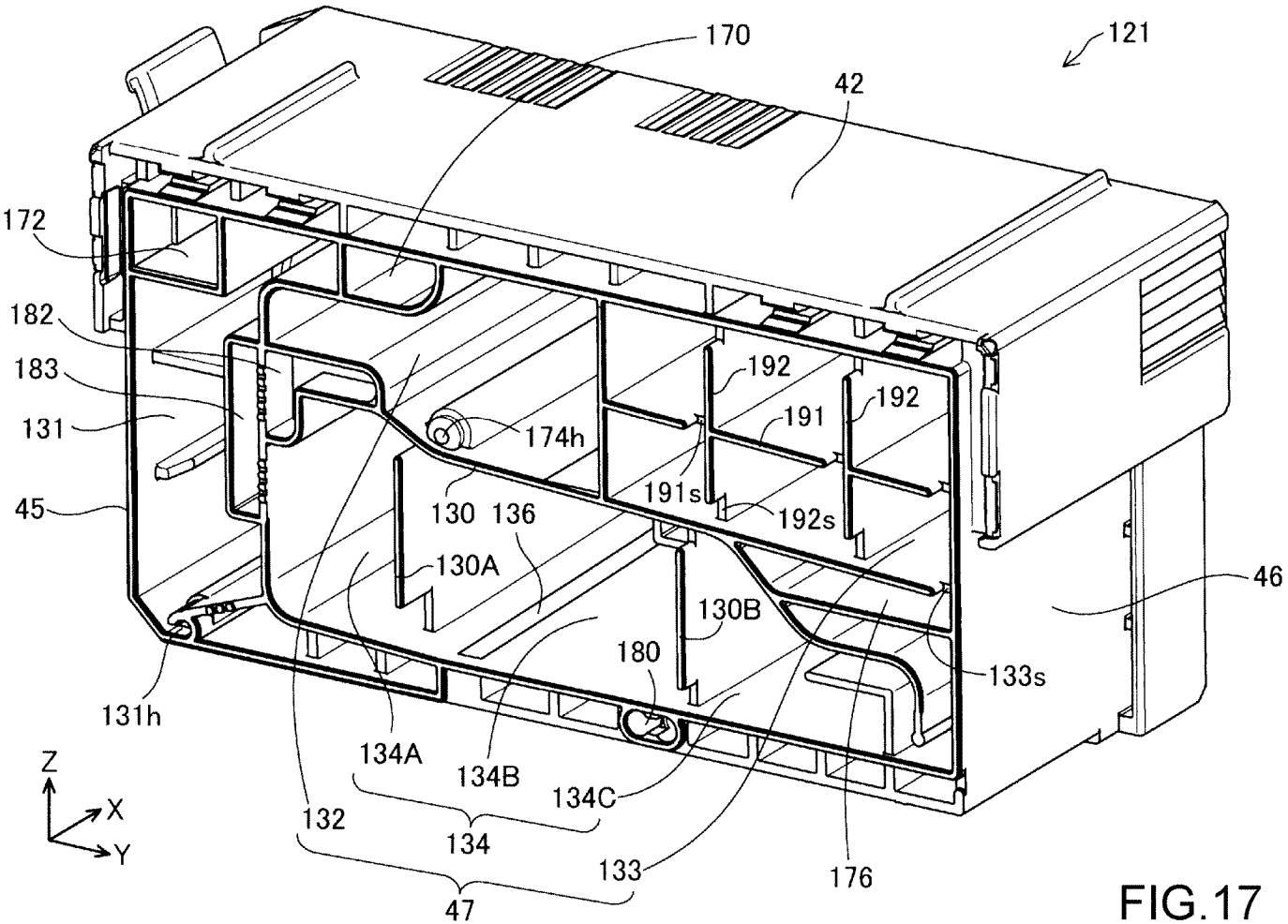
FIG. 17 is a perspective view showing the internal structure on the left wall portion side of the cartridge.
Figure 18:
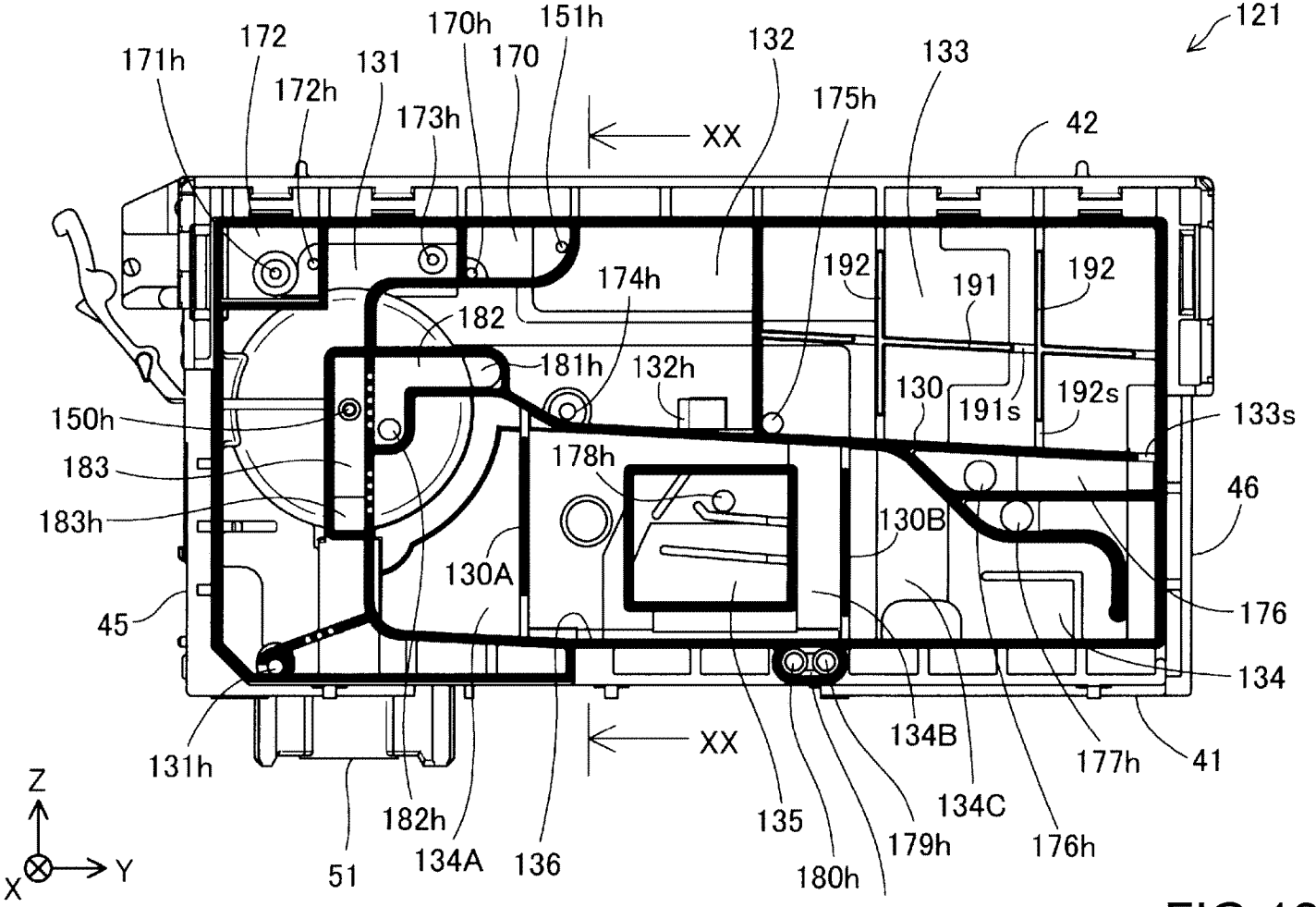
FIG. 18 is a diagram showing the internal structure on the left wall portion side of the cartridge.

FIG. 17 is a perspective view showing the internal structure on the left wall portion 43 side of the cartridge 121. FIG. 18 is a diagram showing the internal structure on the left wall portion 43 side of the cartridge 121. Hereinafter, the left wall portion 43 side of the cartridge 121 is referred to as a "front side".

A Rib 130 having various shapes is formed on the front side of the cartridge 121. A film 68A (see FIG. 20) that covers the entire front side of the cartridge 121 is welded to the front side of the cartridge 121, and a lid member (not illustrated) is then attached to the cartridge 121 over the film 68A, whereby the left wall portion 43 is formed. Note that the lid member may be omitted. Chambers such as an atmospheric air chamber 131, a first tank chamber 132, a second tank chamber 133, and a third tank chamber 134, which will be described later, are sectioned and formed in the cartridge 121 by welding the film 68A to the edge faces on the front side of the bottom wall portion 41, the upper wall portion 42, the rear wall portion 45, and the front wall portion 46, as well as the edge faces on the front side of the rib 130. As shown in FIG. 17, the first tank chamber 132, the second tank chamber 133, and the third tank chamber 134 constitute the above-described liquid storage portion 47. In FIG. 18, thick black lines are used to indicate portions to which the film 68A is welded. Note that in addition to a film covering the entirety front side of the cartridge 121, a film (not illustrated) that only sections and forms a prism chamber 135 is separately welded to the prism chamber 135 shown in FIG. 18. The unit for detection 92 (the prism 93) is arranged on the bottom portion of the prism chamber 135.

Figure 19:
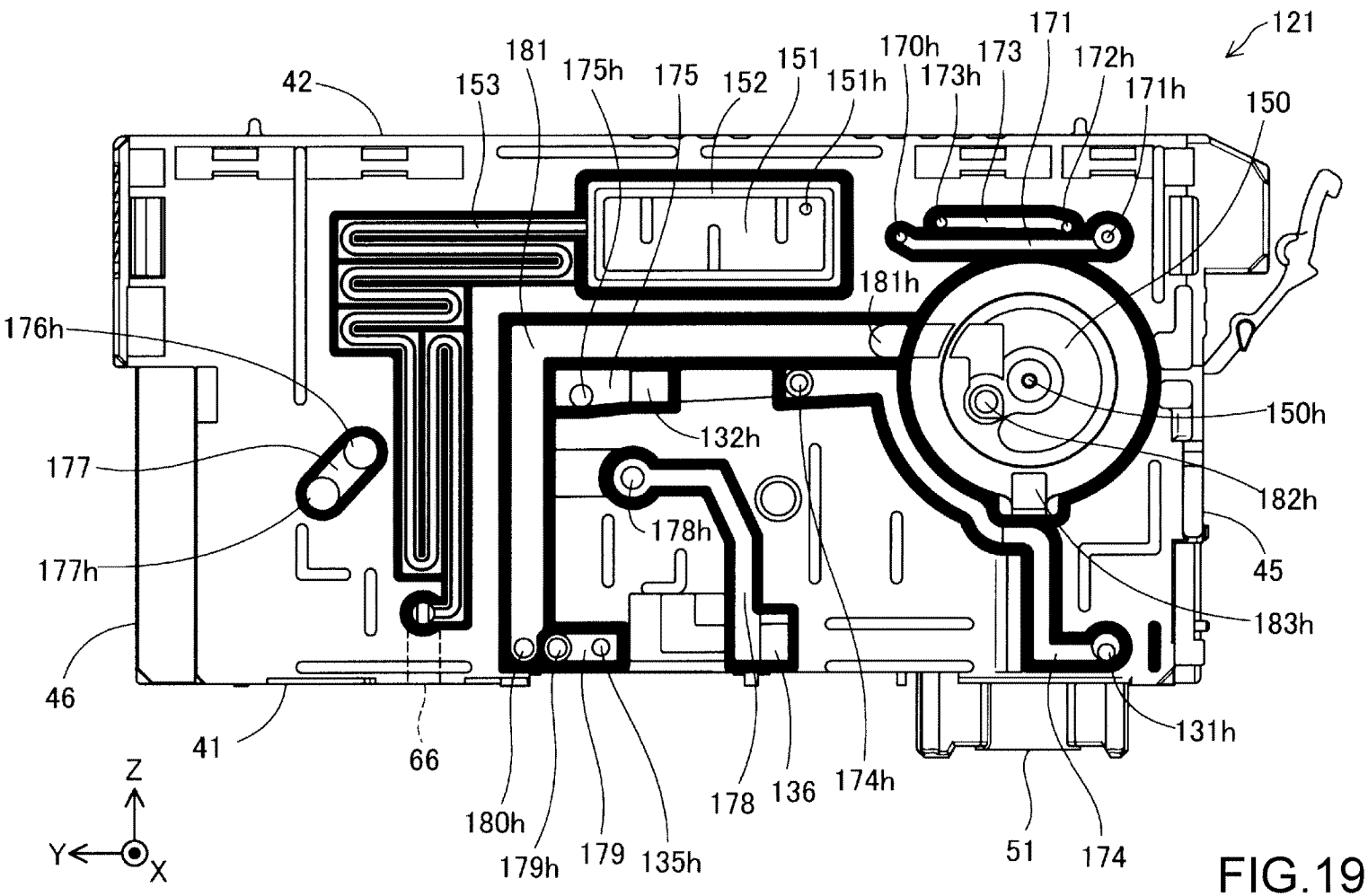
FIG. 19 is a diagram showing the internal structure on the right wall portion side of the cartridge.

FIG. 19 is a diagram showing the internal structure on the right wall portion 44 side of the cartridge 121. Hereinafter, the right wall portion 44 side of the cartridge 121 is referred to as a "back side".

A plurality of grooves are formed on the back side of the cartridge 121. By welding a film 68B (see FIG. 20) to the back side of the cartridge 121, these grooves form a meandering path 153, a gas-liquid separation chamber 151 and communication paths, which will be described later, between the cartridge 121 and the film 68B. In FIG. 19, thick black lines are used to indicate portions to which the film 68B is welded.

A differential pressure chamber 150 and the gas-liquid separation chamber 151 are formed on the back side of the cartridge 121. The differential pressure chamber 150 accommodates a known differential pressure mechanism (not illustrated) including a valve member and a spring. A bank 152 is formed in the internal walls that surround the bottom face of the gas-liquid separation chamber 151, and a gas-liquid separation film (not illustrated) is attached to the bank 152.

Figure 20:
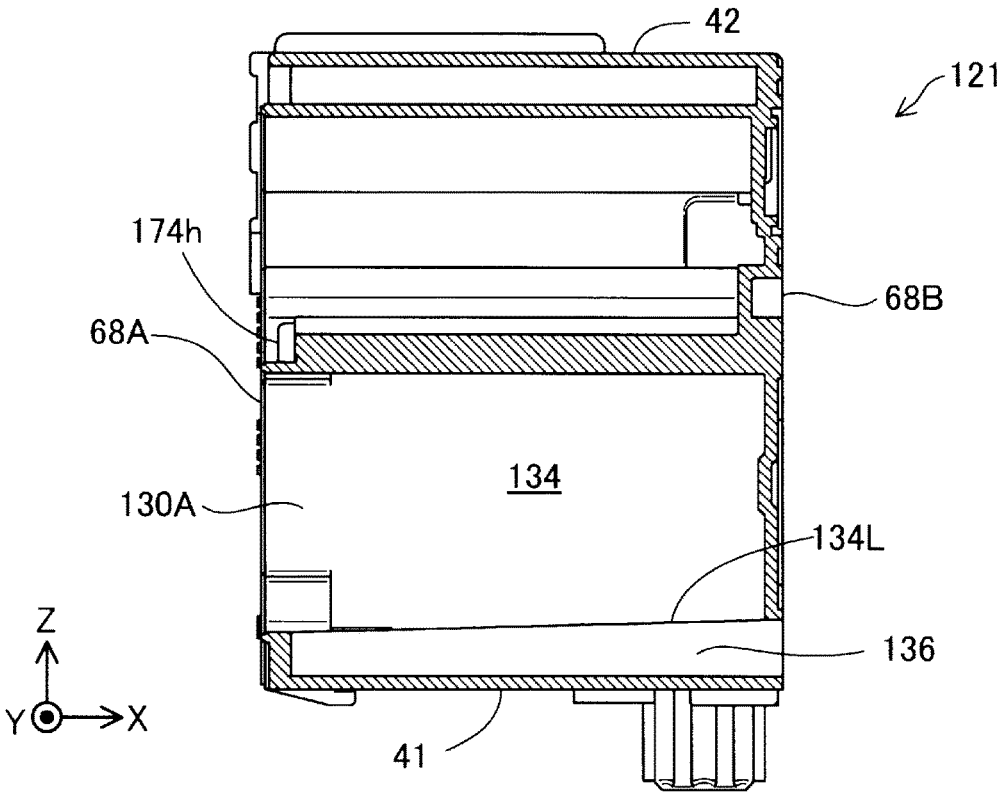
FIG. 20 is a cross-sectional view along XX-XX in FIG. 18.

FIG. 20 is a cross-sectional view along XX-XX in FIG. 18. A groove 136 is provided in the lowest bottom portion of the third tank chamber 134 formed on the front side of the cartridge 121. This groove is referred to as a "residue prevention groove 136". The residue prevention groove 136 is provided in order to prevent ink from remaining in the liquid storage portion 47. In this embodiment, one residue prevention groove 136 is provided in the bottom portion of the third tank chamber 134. The bottom face of the residue prevention groove 136 is substantially horizontal. In addition, when the residue prevention groove 136 is viewed from the +Z axis direction side, the shape of a flow path of the residue prevention groove 136 is a straight line. In addition, a cross-sectional shape of the residue prevention groove 136 is rectangular.

Figure 21:
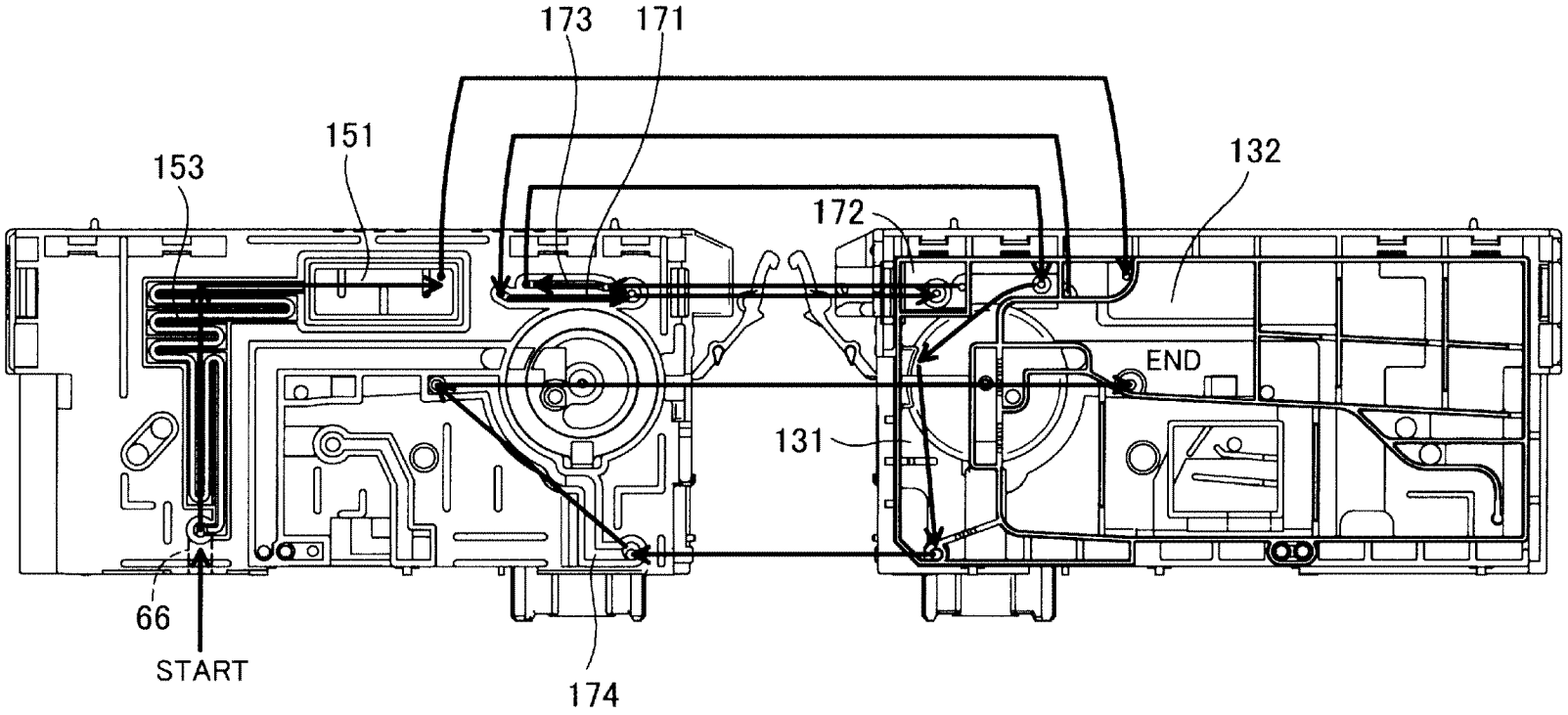
FIG. 21 is a diagram showing a flow of atmospheric air in the cartridge.

FIG. 21 is a diagram showing a flow of atmospheric air in the cartridge 121. Hereinafter, first, a flow of atmospheric air that flows into the cartridge 121 will be described with reference to FIGS. 18, 19, and 21 prior to a flow of ink in the cartridge 121. Atmospheric air flows in the cartridge 121 generally through the atmospheric air opening port 66, the meandering path 153, the gas-liquid separation chamber 151, the atmospheric air chamber 131, and the first tank chamber 132 in the stated order.

Atmospheric air introduced from the atmospheric air opening port 66 (FIG. 19) enters, through the meandering path 153 provided on the back side of the cartridge 121, the gas-liquid separation chamber 151 provided in an upper portion of the back side of the cartridge 121. The meandering path 153 is formed to meander and to be thin and long such that the distance from the atmospheric air opening port 66 to the liquid storage portion 47 is long. Accordingly, it is possible to suppress the evaporation of water in ink in the liquid storage portion 47. The gas-liquid separation chamber 151 allows the penetration of atmospheric air from the meandering path 153 to the liquid storage portion 47, using the function of a gas-liquid separation film (not illustrated) provided therein, but does not allow the penetration of ink from the liquid storage portion 47 to the meandering path 153. Therefore, the gas-liquid separation chamber 151 suppresses the flow of ink that has flowed backward from the liquid storage portion 47 upstream, to the upstream side of the gas-liquid separation chamber 151.

The gas-liquid separation chamber 151 is in communication with the first tank chamber 132 (FIG. 18) provided on the front side of the cartridge 121, through several chambers and communication paths provided on the back side and the front side of the cartridge 121. Specifically, atmospheric air introduced through the gas-liquid separation chamber 151 enters, from an opening 151*h* (FIG. 19) provided in the gas-liquid separation chamber 151, a first spare atmospheric air chamber 170 (FIG. 18) provided above the first tank chamber 132 of the front side of the cartridge 121, and enters, from an opening 170*h* provided in the first spare atmospheric air chamber 170, the end portion on the +Y axis direction side of a first communication path 171 (FIG. 19) provided above the differential pressure chamber 150 on the back side of the cartridge 121 and extending in the Y axis direction. Furthermore, the atmospheric air then enters, from an opening 171*h* provided in the end portion on the −Y axis direction side of the first communication path 171, a second spare atmospheric air chamber 172 (FIG. 18) provided at the corner at which the rear wall portion 45 on the front side of the cartridge 121 and the upper wall portion 42 intersect. The atmospheric air then enters, from an opening 172*h* provided in the second spare atmospheric air chamber 172, the end portion on the −Y axis direction side of a second communication path 173 (FIG. 19) that is provided above the first communication path 171 on the back side of the cartridge 121, and from an opening 173*h* provided in the end portion on the +Y axis direction side of the second communication path 173 that extends in the Y axis direction and is shorter than the first communication path 171, an upper portion of the atmospheric air chamber 131 (FIG. 18) provided along the rear wall portion 45 of the front side of the cartridge 121.

The atmospheric air in the atmospheric air chamber 131 enters, through an opening 131*h* provided in a lower portion of the atmospheric air chamber 131, the end portion on the −Y axis direction side and the −Z axis direction side of a third communication path 174 (FIG. 19) provided on the back side of the cartridge 121, and flows into the first tank chamber 132 (FIG. 18) provided on the front side of the cartridge 121, through an opening 174*h* provided in the end portion on the +Y axis direction side and the +Z axis direction side of the third communication path 174. As the ink in the liquid storage portion 47 is consumed, atmospheric air accordingly flows into the liquid storage portion 47 through the opening 174*h* provided in the first tank chamber 132.

Figure 22:
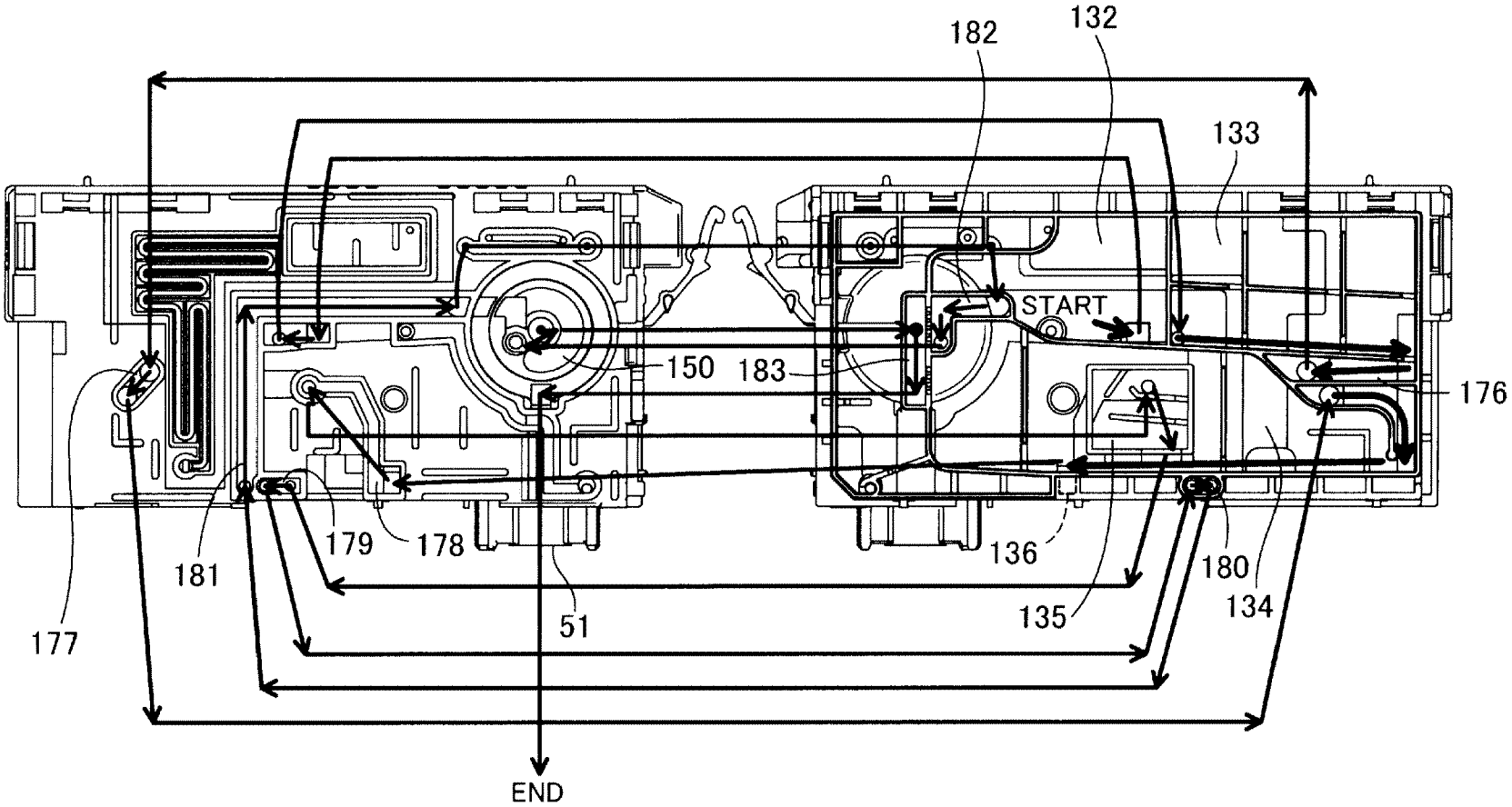
FIG. 22 is a diagram showing a flow of ink in the cartridge.

FIG. 22 is a diagram showing the flow of ink in the cartridge 121. In the cartridge 121, ink generally flows through the first tank chamber 132, the second tank chamber 133, the third tank chamber 134, the residue prevention groove 136, the prism chamber 135, the differential pressure chamber 150, and the liquid supply portion 51 in the stated order. The flow of ink in the cartridge 121 will be described in detail below with reference to FIGS. 18 and 19.

Ink in the first tank chamber 132 (FIG. 18) enters, from an opening 132*h* provided in the bottom portion of the first tank chamber 132, the end portion on the −Y axis direction side of a fourth communication path 175 (FIG. 19) extending in the Y axis direction on the back side of the cartridge 121, and enters, from an opening 175*h* provided in the end portion on the +Y axis direction side of the fourth communication path 175, a lower portion on the −Y axis direction side of the second tank chamber 133 (FIG. 18) provided on the front side of the cartridge 121. Ink in the second tank chamber 133 enters, through a slit 133*s* provided in the end portion on the +Y axis direction side of the rib 130 constituting the bottom wall of the second tank chamber 133, a fifth communication path 176 provided below the second tank chamber 133 and extending in the Y axis direction. The ink that has entered the fifth communication path 176 enters, through an opening 176*h* provided in the end portion on the −Y axis direction side of the fifth communication path 176, the end portion on the +Z axis direction side and the −Y axis direction side of a sixth communication path 177 (FIG. 19) provided on the back side of the cartridge 121. The ink that has entered the sixth communication path 177 enters, through an opening 177*h* provided in the end portions on the −Z axis direction side and the +Y axis direction side of the sixth communication path 177, the vicinity of the end portion in the +Y axis direction of the third tank chamber 134 (FIG. 18) provided on the front side of the cartridge 121. The third tank chamber 134 is arranged on the −Z axis direction side relative to the first tank chamber 132 and the second tank chamber 133.

The third tank chamber 134 has the largest space in the liquid storage portion 47. The liquid storage portion 47 is divided into three spare chambers 134A, 134B and 134C (FIG. 17) by the two ribs 130A and 130B that extend along the Z direction. The three spare chambers 134A, 134B and 134C are aligned from the −Y axis direction toward the +Y axis direction in the stated order. The three spare chambers 134A, 134B and 134C are in communication with each other via slits provided in the upper ends and the lower ends of the ribs 130A and 130B. The residue prevention groove 136 shown in FIG. 20 is provided in the bottom portion of the spare chamber 134B at the center among these spare chambers. In addition, the prism chamber 135 (FIG. 18) is arranged on the back side (the +X axis direction side) of the spare chamber 1346. The bottom faces of the spare chamber 1346 and the spare chamber 134C are substantially horizontal, while the bottom face of the spare chamber 134A that is farthest from the opening 177*h* from which ink is introduced is inclined downward toward the residue prevention groove 136 provided in the spare chamber 134B. Therefore, ink remaining in the spare chamber 134A is suppressed. Note that the bottom portions of the spare chamber 134B and the spare chamber 134C may also be inclined downward toward the residue prevention groove 136. In addition, in this embodiment, as shown in FIG. 20, a bottom portion 134L of the third tank chamber 134 is inclined downward toward the film 68A welded to the front side of the cartridge 121. Therefore, it is possible to allow ink in the third tank chamber 134 to effectively flow to the residue prevention groove 136.

The ink in the third tank chamber 134 enters, through the residue prevention groove 136, the end portions on the −Z axis direction side and the −Y axis direction side of a seventh communication path 178 (FIG. 19) provided on the rear side of the cartridge 121. The ink that has entered the seventh communication path 178 enters, through an opening 178*h* provided in the end portions on the +Z axis direction side and the +Y axis direction side of the seventh communication path 178, an upper portion of the prism chamber 135 (FIG. 18) on the front side of the cartridge 121. A plurality of ribs for trapping air bubbles included in the ink in the prism chamber 135 are provided in the prism chamber 135.

The ink in the prism chamber 135 travels downward in the prism chamber 135 in the −Z axis direction, and comes into contact with the surface of the prism 93 (FIG. 10), and after that, enters, through an opening 135*h* (FIG. 19) provided in a lower portion of the back side of the prism chamber 135, the end portion on the −Y axis direction side of an eighth communication path 179 that is provided on the back side of the cartridge 121, and extends in the Y axis direction. The ink that has entered the eighth communication path 179 enters, through an opening 179*h* provided in the end portion on the +Y axis direction side of the eighth communication path 179, the end portion on the +Y axis direction side of a ninth communication path 180 (FIG. 18) that is provided on the front side of the cartridge 121, and extends in the Y axis direction. The ink that has entered the ninth communication path 180 enters, through an opening 180*h* provided in the end portion on the −Y axis direction side of the ninth communication path 180, the end portions on the −Z axis direction side and the +Y axis direction side of a tenth communication path 181 (FIG. 19) provided in the back side of the cartridge 121. The ink that has entered the tenth communication path 181 enters, through an opening 181*h* that is provided in the end portions on the +Z axis direction side of the −Y axis direction side of the tenth communication path 181, and is adjacent to the differential pressure chamber 150, the end portions on the +Z axis direction side and the +Y axis direction side of an $11^{th}$ communication path 182 (FIG. 18) provided on the front side of the cartridge 121. The ink that has entered the $11^{th}$ communication path 182 enters, through an opening 182*h* provided in the end portions on the −Z axis direction side and the −Y axis direction side of the $11^{th}$ communication path 182, the differential pressure chamber 150 (FIG. 19) provided on the back side of the cartridge 121.

A valve member (not illustrated) in the differential pressure chamber 150 is configured to open when the pressure on the liquid supply portion 51 side drops, and close when the pressure rises. When ink is jetted from the recording head 11 and the pressure on the liquid supply portion 51 is lowered, the valve member opens, and ink in the 11th communication path 182 upstream of the differential pressure chamber 150 enters, through an opening 150*h* provided in the differential pressure chamber 150, a $12^{th}$ communication path 183 (FIG. 18) provided on the front side of the cartridge 121 and extending in the Z axis direction. The ink that has entered the $12^{th}$ communication path 183 reaches, through an opening 183*h* provided at the end portion on the −Z axis direction side of the 12th communication path 183, the liquid supply portion 51.

As shown in FIGS. 17 and 18, in this embodiment, the liquid storage portion 47 has a lateral rib 191 conforming to the bottom wall portion 41. Specifically, in the second tank chamber 133 arranged at a corner at which the front wall portion 46 and the upper wall portion 42 of the cartridge 121 intersect, the lateral rib 191 that extends from the end portion in the −Y axis direction of the second tank chamber 133 to the end portion in the +Y axis direction is provided along the Y axis direction. The lateral rib 191 is provided in the center portion of the second tank chamber 133 in the Z axis direction. In addition, in this embodiment, the liquid storage portion 47 has lengthwise ribs 192 along the rear wall portion 45. Specifically, in the second tank chamber 133, two lengthwise ribs 192 extending from the end portion in the +Z axis direction of the second tank chamber 133 to the end portion in the −Z axis direction are provided along the Z axis direction. The two lengthwise ribs 192 are arranged to be aligned in the Y axis direction and intersect the lateral rib 191. At least one of a lateral rib 191 and a lengthwise rib 192 is also referred to as a "peeling prevention rib". In this embodiment, the lateral rib 191 and the lengthwise ribs 192 are not welded to the film 68A that is welded to the entire front side of the cartridge 121. In addition, the lateral rib 191 and the lengthwise ribs 192 are formed to have a height along the X axis direction lower than the other rib 130, so as to not come in contact with the film 68A. In other words, the height (length) along the X axis direction of the lateral rib 191 and the lengthwise ribs 192 is larger than the distance from the edge faces in the −X axis direction of the lateral rib 191 and the lengthwise ribs 192 to the film 68A.

Rectangular slits 191*s* for circulating ink in the Z axis direction are provided in the edge portions in the −X axis direction of a portion of the lateral rib 191 that is in contact with the front wall portion 46 and portions of the lateral rib 191 that are in contact with the lengthwise ribs 192. In addition, rectangular slits 192*s* for circulating ink in the Y axis direction are also provided in the end portion in the +Z axis direction and the end portion in the −Z axis direction of each of the lengthwise ribs 192. The distance from the edge faces in the −X axis direction of the lateral rib 191 and the lengthwise rib 192 to the film 68A is smaller than the distance from the edge faces in the −X axis direction of the slits 191*s* and 192*s* to the film 68A.

According to the cartridge 121 of this embodiment, the lateral rib 191 and the lengthwise ribs 192 are provided in the second tank chamber 133, and thus in cases such as where the cartridge 121 is dropped, the lateral rib 191 and the lengthwise ribs 192 receive the movement of ink in the second tank chamber 133, and suppress rapid movement of the ink. Therefore, impact on the welding portion between the rib 130 that sections the second tank chamber 133 and the film 68A as ink moves is mitigated. As a result, it is possible to suppress peeling of the film 68A from the rib 130.

In particular, the cartridge 121 of this embodiment is internally partitioned into the tank chambers 132,133 and 134, and the volume of the third tank chamber 134 that is positioned at the lowest position among those chambers is the largest. Therefore, more ink is contained on the liquid supply portion 51 side provided in a lower portion of the cartridge 121, the weight on the liquid supply portion 51 side is larger, and thus there is a high risk that the cartridge 121 will fall on the liquid supply portion 51 side. If the cartridge 121 falls on the liquid supply portion 51 side, a large amount of ink will flow backward through communication paths upon being dropped, and ink moves toward the second tank chamber 133 that is at a position opposite to the liquid supply portion 51. At this time, in this embodiment, the lateral rib 191 is provided inside the second tank chamber 133, and thus impact caused by this movement of ink is suppressed, and it is possible to suppress peeling, from the rib 130, of the film 68A that sections and forms the second tank chamber 133.

In addition, in this embodiment, the height (length) in the X axis direction of the lateral rib 191 is longer than the distance from the edge face in the −X axis direction of the lateral rib 191 to the film 68A, and thus when the cartridge 121 falls, movement of ink in the gravity direction can be effectively received. In addition, in this embodiment, the space from edge face in the −X axis direction of the lateral rib 191 to the film 68A is smaller than the distance from the edge face in the −X axis direction of the slits 191*s* provided on the lateral rib 191 to the film 68A, and thus when the cartridge 121 falls, the movement of ink in the gravity direction can be effectively received.

In addition, in this embodiment, the lateral rib 191 and the lengthwise ribs 192 are not joined to the film 68A. Therefore, it is possible to suppress tearing of the film 68A from these joint portions in a case where ink is frozen and is inflated, for example. In addition, in this embodiment, the lateral rib 191 and the lengthwise ribs 192 are not in contact with the film 68A. Therefore, during a process of welding the film 68A to the rib 130, it is possible to suppress erroneous welding of the film 68A to the lateral rib 191 and the lengthwise ribs 192. In addition, the lateral rib 191 and the lengthwise ribs 192 are not in contact with the film 68A, and thus when depressurizing the entire cartridge 121 at the time of shipping the cartridge 121, the film 68A can be supported without any stress using the lateral rib 191 and the lengthwise ribs 192.

D. Modified Examples

Modified Example 1

In the above embodiment, one residue prevention groove 136 is provided in the bottom portion of the third tank chamber 134. However, any number of residue prevention grooves 136, and any shape and arrangement location of the residue prevention groove 136 may be adopted. For example, two or more residue prevention grooves 136 may be provided, and may be provided in a tank chamber other than the third tank chamber 134. In addition, a cross-sectional shape of the residue prevention groove 136 may be rectangular, and may be partially curved. In addition, when viewed from the +Z axis direction side, the residue prevention groove 136 may be straight or curved. In addition, the bottom face of the residue prevention groove 136 may be horizontal, and may be inclined so as to be deeper toward the seventh communication path 178 which is connected thereto. In addition, the residue prevention groove 136 may be configured as a thin groove through which ink is made to flow through capillary action.

Modified Example 2

In the above embodiment, both the lateral rib 191 and the lengthwise ribs 192 are provided in the second tank chamber 133. However, the lateral rib 191 or one of the lengthwise ribs 192 may be omitted. In addition, in the second tank chamber 133, a plurality of lateral ribs may be provided so as to be aligned in the Z axis direction, and one or three or more lengthwise ribs may be provided so as be aligned in the Y axis direction.

Modified Example 3

In the above embodiment, the lateral rib 191 and the lengthwise ribs 192 are provided in the second tank chamber 133 arranged at a position in the corner opposite to the liquid supply portion 51. However, the lateral rib 191 and at least one of the lengthwise ribs 192 may be provided in at least one of the first tank chamber 132, the second tank chamber 133, and the third tank chamber 134.

Modified Example 4

In the above embodiment, the lateral rib 191 and the lengthwise ribs 192 are not welded to the film 68A. However, the film 68A may be welded to the lateral rib 191 and at least one of the lengthwise ribs 192. In addition, the lateral rib 191 and at least one of the lengthwise ribs 192 may simply come into contact with the film 68A without being welded.

Modified Example 5

In the above embodiment, the lateral rib 191 is provided along the Y axis direction. However, as long as movement of ink in the gravity direction can be prevented, the lateral rib 191 may be inclined relative to the Y axis direction within the range of ±15°, for example. In addition, the position of the lateral rib 191 is not limited to the center in the Z axis direction of the second tank chamber 133, and may be arranged at a position close to one of the end portions in the Z axis direction.

Modified Example 6

In the above embodiment, the distance from the edge face in the −X axis direction of the lateral rib 191 and the lengthwise ribs 192 to the film 68A is shorter than the depth along the Z axis direction of the slits 191*s* and 192*s* provided in the lateral rib 191 and the lengthwise ribs 192. However, the distance from the edge face in the −X axis direction of the lateral rib 191 and the lengthwise ribs 192 to the film 68A may be longer than the depth along the Z axis direction of the slits 191*s* and 192*s* provided in the lateral rib 191 and the lengthwise ribs 192.

Modified Example 7

In the above embodiment, the liquid supply portion 51 is provided on the bottom wall portion 41. However, the liquid supply portion 51 may be provided on any of the left wall portion 43, the right wall portion 44, and the front wall portion 46.

Modified Example 8

The invention is not limited to an inkjet printer and a cartridge thereof, and can also be applied to any liquid consumption apparatus that consumes a liquid other than ink and a cartridge (liquid container) used for such a liquid consumption apparatus. For example, the invention can be applied as a cartridge used for various liquid ejection apparatuses as follows:

1. an image recording apparatus such as a facsimile apparatus,
2. a color material ejection apparatuses used for manufacturing color filters for an image display device such as a liquid crystal display,
3. an electrode material ejection apparatuses used for forming electrodes for an organic EL (Electro Luminescence) display, an FED (Field Emission Display), and the like,
4. a liquid ejection apparatus that ejects a liquid containing biological organic matter used for manufacturing biochips,
5. a sample ejection apparatus serving as a precision pipette,
6. a lubricant ejection apparatus,
7. a resin liquid ejection apparatus,
8. a liquid ejection apparatus that ejects a lubricant onto precision instruments such as time pieces and cameras with pinpoint accuracy,
9. a liquid ejection apparatus that ejects a transparent resin liquid such as an ultraviolet-curing resin liquid onto a substrate in order to form, for example, a hemispherical micro lens (optical lens) used in an optical communication element or the like,
10. a liquid ejection apparatus that ejects an acid or alkali etching solution in order to etch a substrate or the like, and
11. a liquid ejection apparatus provided with a liquid consumption head for discharging a minute amount of any other liquid droplets.

Note that "liquid droplets" refer to a state of a liquid that is discharged from a liquid ejection apparatus, and includes a liquid in the form of particles, tears, or threads that leave a trail. It suffices for the "liquid" to be a material that can be consumed by the liquid ejection apparatus. For example, it suffices for the "liquid" to be a material in a state where the substance is in the liquid phase, and the "liquid" includes materials in a liquid state such as high- or low-viscosity liquids, and materials in a liquid state such as sols, gel waters, other inorganic solvents, organic solvents, solutions, liquid resins, and liquid metals (molten metals). The "liquid" also includes not only liquids in the form of one state of a substance, but also solvents into which particles of a functional material composed of a solid matter such as a pigment or metal particles has been dissolved, dispersed or mixed, and the like. Representative examples of liquids include ink, such as was described in the above embodiment, liquid crystal and the like. Herein, the term "ink" encompasses a variety of compositions in the form of a liquid, such as general water-soluble inks and oil-soluble inks as well as gel inks, and hot melt inks.

The invention is not limited to the above embodiment and modified examples, and can be achieved as various configurations without departing from the gist of the invention. For example, the technical features in the embodiment and modified examples that correspond to the technical features in the modes described in the summary of the invention may be replaced or combined as appropriate in order to solve a part of, or the entire foregoing problem, or to achieve some or all of the above-described effects. The technical features that are not described as essential in the specification may be deleted as appropriate.

What is claimed is:

1. A liquid container that contains liquid that is used in a liquid consumption apparatus, comprising:

a liquid storage portion that is surrounded by a plurality of wall portions, and contains liquid in the liquid storage portion; and a plurality of contact portions are provided on a first wall portion among the plurality of wall portions, the plurality of contact portions contact with terminals on-the-apparatus-side provided in the liquid consumption apparatus, when the liquid container is mounted in the liquid consumption apparatus, wherein the plurality of contact portions are provided at a position closer to a first edge side than a second edge side of the first wall portion, the first edge side and the second edge side are positioned opposite each other along the first wall portion, at least some contact portions, from among the plurality of contact portions, form at least one column arranged along the first edge side, the liquid container includes protruding portions outward of outer contact portions that are the outermost contact portions in the column, the protruding portions are provided between an end portion on the first edge side of the outer contact portions and the first edge side in a direction from the first edge side toward the column, the protruding portions protrude in front of the entire first wall portion.

2. The liquid container according to claim 1, wherein the protruding portions protrude more than the plurality of contact portions.

3. The liquid container according to claim 1, further comprising:

a second wall portion that intersects the first wall portion, wherein a liquid supply portion for supplying the liquid to the liquid consumption apparatus is provided on the second wall portion, and the liquid supply portion is provided on the second wall portion, at a position close to the first edge side of the first wall portion.

* * * * *